United States Patent [19]

Hirai

[11] Patent Number: 4,745,043

[45] Date of Patent: May 17, 1988

[54] HEAT DEVELOPMENT METHOD FOR FORMING AN IMAGE USING INTENSIFYING AGENTS

[75] Inventor: Hiroyuki Hirai, Kanagawa, Japan

[73] Assignee: Fuji Photo Film Co., Ltd., Kanagawa, Japan

[21] Appl. No.: 889,059

[22] Filed: Jul. 25, 1986

[30] Foreign Application Priority Data

Jul. 25, 1985 [JP] Japan ..... 60-164645

[51] Int. Cl.[4] ..... G03C 5/54; G03C 7/00

[52] U.S. Cl. ..... 430/203; 430/351; 430/373; 430/936; 430/943

[58] Field of Search ..... 430/203, 351, 373, 936, 430/943

[56] References Cited

U.S. PATENT DOCUMENTS 4,062,684 12/1977 Hara et al. ..... 430/351
4,084,969 4/1978 Nakamura et al. ..... 430/373
4,626,499 12/1986 Kato et al. ..... 430/203
4,629,675 12/1986 Takehara et al. ..... 430/203
4,668,612 5/1987 Hirai ..... 430/351

FOREIGN PATENT DOCUMENTS 0121765 10/1984 European Pat. Off. ..... 430/203
3201557 7/1983 Fed. Rep. of Germany ..... 430/203

*Primary Examiner*—Richard L. Schilling
*Attorney, Agent, or Firm*—Sughrue, Mion, Zinn, Macpeak, and Seas

[57] ABSTRACT

A method for forming an image, which comprises heating a light-sensitive material comprising a support having thereon at least a light-sensitive silver halide, a binder, and a dye providing substance simultaneously with or after imagewise exposure thereof in the presence of water, a reducing agent, and at least one kind of intensifying agent. In accordance with the method of the present invention, images having a high density can be obtained in a short period of time using reduced amounts of silver and base. A heat-developable photographic material containing intensifying agent is also described.

22 Claims, No Drawings

HEAT DEVELOPMENT METHOD FOR FORMING AN IMAGE USING INTENSIFYING AGENTS

FIELD OF THE INVENTION

The present invention relate to a method for forming a dye image by heating. More particularly, the present invention relates to a method for forming a dye image in which images having a high density are obtained in a short period of time in spite of using reduced amounts of silver and base.

BACKGROUND OF THE INVENTION

In recent years, techniques have been developed which enable simple and rapid image formation by changing the image forming processing for photographic materials using silver halide from the conventional wet process using a developing solution or the like to a dry process using heat application or like means.

Many methods for obtaining color images by heat development have been proposed. For instance, with respect to a method for forming color images by binding couplers to oxidation products of developing agents, there have been proposed combinations of p-phenylenediamine type reducing agents and phenolic or active methylene couplers as described in U.S. Pat. No. 3,531,286, reducing agents of p-aminophenol type as described in U.S. Pat. No. 3,761,270, reducing agents of sulfonamidophenol type in Belgian Pat. No. 802,519 and *Research Disclosure,* pp. 31–32 (September, 1975), and combinations of sulfonamidophenol type reducing agents with four-equivalent couplers in U.S. Pat. No. 4,021,240.

Further, with respect to a method for forming positive color images using the light-sensitive silver dye bleach process, useful dyes and bleaching methods are described, for example, in *Research Disclosure,* RD No. 14433, pp. 30–32 (April, 1976), ibid., RD No. 15227, pp. 14–15 (December, 1976), and U.S. Pat. No. 4,235,957.

However, these methods are disadvantageous in that color images obtained are turbid because dye images and silver images or silver salts are coexistent and in that isolated silver is formed during preservation.

In order to overcome the disadvantages described above, a method employing reductive dye providing substances capable of releasing a hydrophilic dye is described in Japanese Patent Application (OPI) No. 58543/83 (the term "OPI" as used herein refers to a "published unexamined Japanese patent application"). According to this method, a light-sensitive material containing a silver halide and a dye providing substance which acts as a reducing agent to silver halide at a high temperature and at the same time which is oxidized itself to release a mobile dye is heated simultaneously with or after imagewise exposure under the condition of being substantially free from water, whereby a mobile dye is formed imagewise.

In such a method of forming an image, a step for forming imagewise a mobile dye by heating and a step for transferring the mobile dye to a dye fixing layer are necessary. It becomes possible to realize a rapid and easy processing if the two steps can be carried out at the same time. From such a viewpoint various investigations had been made, and, as a result, it was found that this can be accomplished with superposing a light-sensitive material and a dye fixing material under the condition of retaining water in the presence of a base or a base precursor which is capable of releasing a base by heating and heating at a temperature lower than the boiling point of a solution (see Japanese Patent Application (OPI) No. 218443/84). Further, with respect to a so-called monosheet type light-sensitive material in which a dye fixing layer is integrated into the light-sensitive material, it was found that this can be achieved by heating under the condition of retaining water by means of coming into intimate contact with a material through which moisture hardly permeates, such as a polyethylene terephthalate film, etc.

However, in the dye images obtained by these methods of forming images bases remain, which may cause problems on health for human body. Therefore, it has been desired to develop a method which can form an image using a base in a concentration as low as possible.

Moreover, it is advantageous in view of saving resources that the amount of silver salt, such as light-sensitive silver halide and organic silver salt, to be employed as a medium for obtaining color images be reduced as much as possible.

From such a point of view, in the field of conventional wet processes using a developing solution or the like, there has been disclosed a method for forming a color image in which a dye image is intensified by means of catalytic function of reduced silver formed imagewise using a so-called intensifying agent. For instance, a method of intensification using a peroxide such as hydrogen peroxide, etc., as an intensifying agent is described in Friedman, *History of Color Photography,* 2nd Edition, page 406 (1956), West German Patent Application (OLS) Nos. 1,961,029, 2,056,360 and 2,044,993, Japanese Patent Application (OPI) No. 18629/83, etc.; a method using a salt of halogenous acid such as a chlorite, etc., is described in Japanese Patent Application (OPI) Nos. 53826/76 and 13336/77, etc.; and a method using a polyvalent iodine compound such as iodosobenzoic acid, etc., is described in Japanese Patent Application (OPI) No. 73731/82, etc. Among these methods, the method using a peroxide such as hydrogen peroxide, etc., as an intensifying agent is particularly advantageous because it has high amplification efficiency, is free from coloration, and provides harmless reaction products.

It is also known, however, that with respect to the method of forming color images using an intensifying agent, halide ions or various antifogging agents present in a developing solution act as catalyst poison, and reduced silver is poisoned, which results in sever reduction of the amplifying efficiency. In particular, in a case where the intensification processing is carried out using a small amount of solution, the reduction in the amplifying efficiency is considerably large.

Therefore, it is extremely significant from the standpoint of saving resources if dye images having a sufficiently high density can be obtained in a short period of time from a light-sensitive material having a low coating amount of silver using a small amount of solution, preferably water.

SUMMARY OF THE INVENTION

An object of the present invention is to provide a method for forming an image having a high density and low fog in a short period of time, even in the case of using a small amount of water and a reduced amount of base and silver.

Other objects of the present invention will become apparent from the following detailed description and examples.

The objects of the present invention are accomplished by a method for forming an image which comprises heating a light-sensitive material comprising a support having thereon at least a light-sensitive silver halide, a binder, and a dye providing substance simultaneously with or after imagewise exposure thereof in the presence of water, a reducing agent, and at least one kind of intensifying agent.

DETAILED DESCRIPTION OF THE INVENTION

In accordance with the method for forming an image of the present invention, the light-sensitive material is heated simultaneously with or after imagewise exposure in the presence of water, a reducing agent and at least one kind of intensifying agent.

In the present invention, the water which is present at the time of heating can be, partially or wholly, previously incorporated into the light-sensitive material and/or the dye fixing material, or can be supplied from outside. In order to incorporate water into the materials, it is necessary to employ specific means which result in a high cost of production. Accordingly, it is generally advantageous to supply water externally.

Any of known intensifying agents can be utilized in the method of the present invention. Representative intensifying agents include peroxides such as hydrogen peroxide, etc., cobalt (III) complexes, salts of halogenous acid, polyvalent iodine compounds, and the like.

Such intensifying agents can be partially or wholly incorporated into the light-sensitive material and/or the dye fixing material. Alternatively, they can be employed by adding to water when water is supplied from the outside. In the case of incorporating the intensifying agent into the materials, it is preferred to incorporate it into the dye fixing material in view of stability of the intensifying agent.

Also, the method for supplying the intensifying agent from the outside as an aqueous solution thereof together with water is easy and desirably employed.

With respect to peroxides, especially hydrogen peroxide, it is particularly advantageous from the standpoint of handling to supply them as an aqueous solution from the outside.

In the following, the intensifying agents which can be used in the present invention are illustrated in greater detail.

The peroxides which can be employed in the present invention include hydrogen peroxide and compounds capable of releasing hydrogen peroxide upon coming into contact with water. Examples of the compounds capable of releasing hydrogen peroxide include compounds having an $O_2^{2-}$ groups, for example, $Li_2O_2$, $Na_2O_2$, $K_2O_2$, $Rb_2O_2$, $Cs_2O_2$, $MgO_2$, $CaO_2$, $SrO_2$, $BaO_2$, $ZnO_2$, $CrO_5$, etc.; compounds having an $O_2^-$ groups, for example, $NaO_2$, $KO_2$, $CaO_4$, etc.; dialkyl peroxides, for example, diethyl peroxide, di-tert-butyl peroxide, etc.; peroxo acids, for example, peroxobenzoic acid, peroxoacetic acid, peroxoformic acid, peroxonitric acid, peroxosulfuric acid, peroxodisulfuric acid, peroxophosphoric acid, peroxodiphosphoric acid, peroxocarbonic acid, peroxotitanic acid, peroxoboric acid, etc., and salts thereof (particularly, alkali mtal salts, alkaline earth metal salts, ammonium salts, etc.), and the like.

The optimum amount of the peroxide used in the present invention may vary depending on the kind of the peroxide or the system in which it is used. In case of incorporating it into the light-sensitive material and/or the dye fixing material, it is suitably used in an amount of 50 wt% or less, preferably in a range from 0.01 wt% to 40 wt%, based on the total weight of the whole coated layer. Further, in the case of supplying externally by dissolving it in the water used in the present invention, a concentration ranging from $2\times10^{-3}$ mol/l to 10 mol/l, and particularly from $1\times10^{-2}$ mol/l to 5 mol/l, is preferred.

It is desired that the peroxide used in the present invention is added at a molar ratio with respect to the dye providing substance from 0.05/1 to 200/1, and a molar ratio of from 0.5/1 to 80/1 is particularly desirable.

It is preferred in the present invention to use at least one compound selected from the compounds as described in W. C. Schumb et al., *Hydrogen Peroxide,* pages 515 to 547 and *Research Disclosure,* No. 11660 (December, 1973); organic phosphonic acid compounds as described in Japanese Patent Application (OPI) Nos. 10523/77 and 127555/80; and aminocarboxylic acids represented by ethylenediaminetetraacetic acid, nitrilotriacetic acid, cyclohexanediaminetetraacetic acid, iminodiacetic acid, hydroxyethyliminodiacetic acid, hydroxyethylethylenediaminetriacetic acid, glycol ether diaminetetraacetic acid, diethylenetriaminepentaacetic acid, triethylenetetraminehexaacetic acid, diaminopropanoltetraacetic acid, ethylenediaminediorthohydroxyphenylacetic acid, etc., or salts thereof, as a stabilizing agent for the peroxide.

The amount of the stabilizing agent added is preferably at the molar ratio with respect to the peroxide of from 0.001/1 to 10/1, and particularly preferably is from 0.01/1 to 1/1.

The cobalt (III) complexes which can be employed in the present invention include, for example, the compounds described in detail in Japanese Patent Application (OPI) No. 9728/73, etc. Particularly useful cobalt (III) complexes are those having the coordination number of 6 and having a ligand selected from ethylenediamine, diethylenetriamine, triethylenetetramine, ammonia, a nitrate ion, a nitrite ion, an azide ion, a chloride ion, a thiocyanate ion, an isothiocyanate ion, water, a carbonate ion, and propylenediamine.

Very useful coblt (III) complexes include the amine complexes as described below.

$[Co(NH_3)_5\ H_2O]X_{3/n}$ $[Co(NH_3)_5\ CO_3]X_{2/n}$ $[Co(NH_3)_5\ Cl]X_{1/n}$ wherein X represents an anion, for example, a bromide ion, a chloride ion, a nitrate ion, a thiocyanate ion, a dithionate ion, a hydroxide ion, etc.; and n represents the valence number of the anion.

In a particularly preferred embodiment, the cobalt (III) complexes used in the present invention are those in which at least three, and preferably at least five coordinate positions are occupied with amine ($NH_3$) ligands and/or the charge of the complex ion is positive, preferably +3.

The cobalt (III) complex can be added to the light-sensitive material and/or the dye fixing material in the form of a water-insoluble ion pair as described in U.S. Pat. No. 3,847,619.

The amount of the cobalt (III) complex used in the present invention may vary depending on the kind of the cobalt (III) complex or the system in which it is used. In the case of incorporating it into the light-sensitive material and/or the dye fixing material, it is suitable to use in an amount of 50 wt% or less, preferably in a range from 0.01 wt% to 40 wt%, based on the total weight of the whole coated layer. Further, in case of supplying externally by dissolving it in the water used in the present invention, a concentration ranging from $1\times10^{-4}$ mol/l to $5\times10^{-1}$ mol/l, and particularly from $1\times10^{-3}$ mol/l to $1\times10^{-1}$ mol/l is preferred.

It is desired that the cobalt (III) complex which can be used in the present invention is added at the molar ratio to the dye providing substance from 0.01/1 to 200/1, and particularly from 0.1/1 to 80/1.

The salts of halogenous acid which can be employed in the present invention includes those as described in Japanese Patent Application (OPI) No. 53826/76, etc. Particularly useful slats of halogenous acid are chlorites. Examples of counter ions for the salts of halogenous acid include an alkali metal (for example, lithium, sodium, potassium, etc.) ion, an alkaline earth metal (for example, magnesium, calcium, strontium, barium, etc.) ion, an ammonium ion, a quaternary alkylammonium ion, a guanidium ion, an amidinium ion, etc. In particular, sodium chlorite and potassium chlorite are preferred.

The amount of the salt of halogenous acid used in the present invention may vary depending on the kind of the salt of halogenous acid or the system in which it is used. In the case of incorporation into the light-sensitive material and/or the dye fixing material, it is suitable to use in an amount of 50 wt% or less, preferably in a range from 0.01 wt% to 40 wt%, based on the total weight of the whole coated layers. Further, in the case of supplying externally by dissolving it in the water used in the present invention, a concentration ranging from $1\times10^{-3}$ mol/l to 6 mol/l, and particularly from $1\times10^{-2}$ mol/l to 3 mol/l, is preferred.

It is desired that the salt of halogenous acid which can be used in the present invention is added at a molar ratio with respect to the dye providing substance from of 0.01/1 to 200/1, and particularly preferrably from 0.1/1 to 80/1.

The polyvalent iodine compounds which can be employed in the present invention include compounds containing an iodine atom having a valency of +3, +5, or +7. Particularly useful compounds are organic polyvalent iodine compounds represented formula (I)

$$R\text{-}(Z)_n \qquad (I)$$

wherein R represents a substituted or unsubstituted alkenyl group having from 2 to 10 carbon atoms, a substituted or unsubstituted aryl group having from 6 to 18 carbon atoms (monocyclic or polycyclic composed of 5-membered or 6-membered rings) or a substituted or unsubstituted heterocyclic group (preferably, a 5-membered or 6-membered nitrogen-containing heterocyclic group). Examples of the substituents include a chlorine atom, an alkyl group, a carboxyl group, a sulfo group, a cyano group, a nitro group, an acylamino group, an acyl group, a phenylazo group, an arylsulfonyl group, etc. Z represents —IO, —$IO_2$, —$IX_2$ or —$I^{\oplus}$—R'.$Y^{\ominus}$ wherein X represents a chlorine atom or an acyloxy group containing an alkyl moiety having from 1 to 8 carbon atoms or an aryl moiety and wherein the alkyl or aryl moiety may be substituted with a chlorine atom, etc.; $Y^{\ominus}$ represents a monovalent anion (for example, $Cl^{\ominus}$, $CH_3COO^{\ominus}$, etc.); and R' represents a substituted or unsubstituted alkenyl group having from 2 to 10 carbon atoms or a substituted or unsubstituted aryl group (monocyclic or polycyclic composed of 5-membered or 6-membered rings).

Of the compounds represented by formula (I), aromatic polyvalent iodine compounds in which R represents an aryl group or an aromatic heterocyclic group have good stability and provide preferred results.

Specific examples of the polyvalent iodine compounds which can be used in the present invention are set forth below, but the present invention is not to be construed as being limited thereto.

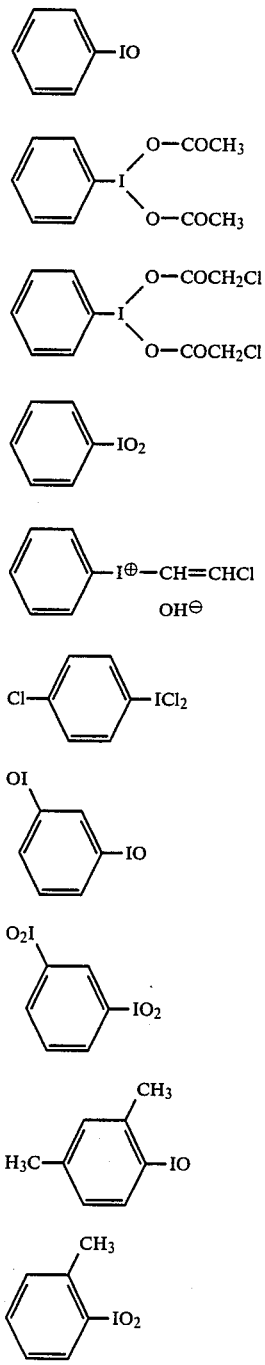

-continued
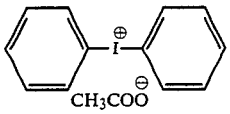
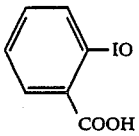
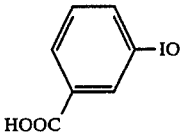
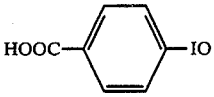
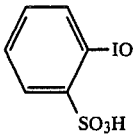
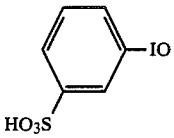
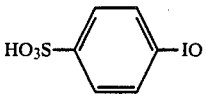
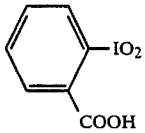
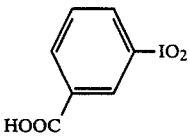
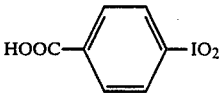
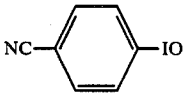
-continued
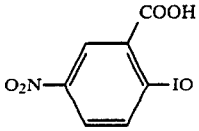
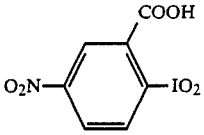
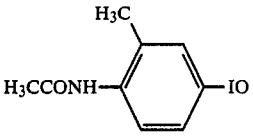
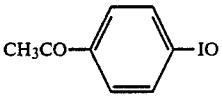
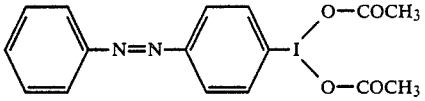
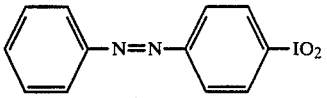
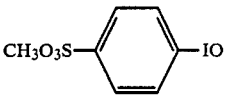
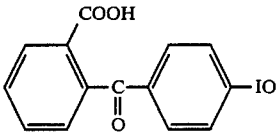
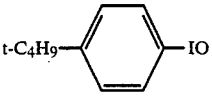
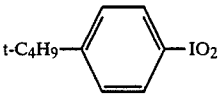
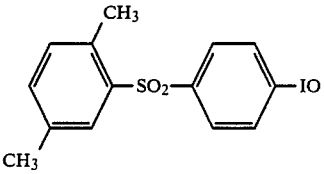
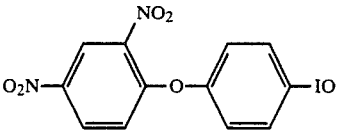

-continued

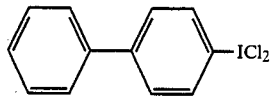

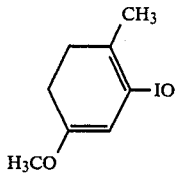

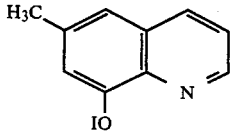

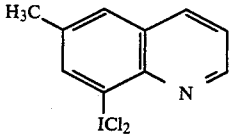

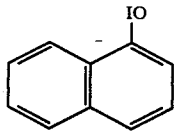

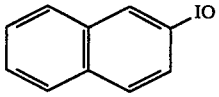

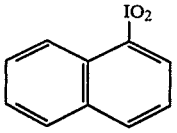

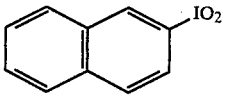

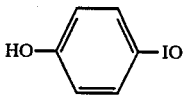

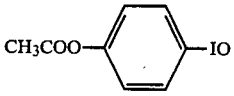

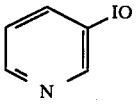

-continued

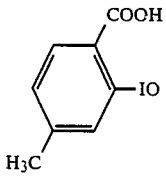

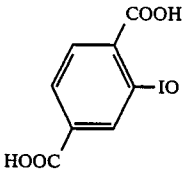

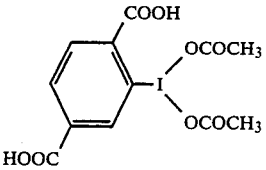

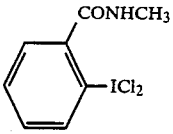

In the above described compounds having an acid group such as —COOH, —$SO_3H$, etc., as a substituent, the hydrogen atom (hydrogen ion) may be replaced with an alkali metal ion, an alkaline earth metal ion, a quaternary ammonium ion, a guanidium ion, etc., to form a salt.

These compounds can be synthesized by well known methods. Typical synthesis methods are described, for example, in (1) *Org. Syn. Coll.*, Vol. III, pages 482 to 487, (2) *Org. Syn. Coll.*, Vol. V, pages 658 to 663 and 665 to 667, and (3) Fieser & Fieser, *Reagents for Organic Synthesis*, pages 506 to 511, etc.

The amount of the polyvalent iodine compounds used in the present invention may vary depending on the kind of the polyvalent iodine compound or the system in which it is used. In case of incorporating it into the light-sensitive material and/or the dye fixing material, it is suitably used in an amount of 50 wt% or less, preferably in a range from 0.01 wt% to 40 wt%, based on the total weight of the whole coated layers. Further, in the case of supplying externally by dissolving it in the water used in the present invention, a cncentration ranging from $1\times10^{-4}$ mol/l to 1 mol/l, and particularly from $1\times10^{-3}$ mol/l to $5\times10^{-1}$ mol/l, is preferred.

It is desired that the polyvalent iodine compound which can be used in the present invention is added at a molar ratio with respect to the dye-providing substance of from 0.01/1 to 200/1, and preferably from 0.1/1 to 80/1.

In order that the intensifying agent does not hinder the observation of a dye image, it is preferred that the intensifying agent does not have a large absorption in a visible region. Specifically, those compounds having a molar extinction coefficient $\epsilon$ of 100 or less at 400 nm. At this point, peroxides and polyvalent iodine compounds are preferred as the intensifying agennt.

The amount of water used in the present invention is at least 0.1 time the total weight of the whole coated layers.

The term "whole coated layers" referred to herein means coated layers of both the light-sensitive material and the dye fixing material when the dye fixing material is used. Preferably, it is in a range from 0.1 time the total weight of the whole coated layers to the weight of water corresponding to the maximum swelling volume of the whole coated layers. It is more preferred to select the amount in a range from 0.1 time the total weight of the whole coated layers to a value obtained by subtracting the total weight of the whole coated layers from the weight of water corresponding to the maximum swelling volume of the whole coated layers.

Since the condition of the layers at the swelling is unstable, there is a possibility of the occurrence of local ooze. In order to avoid such a problem, it is desirable to control the amount of water under the level corresponding to the maximum swelling volume of the whole coated layers in the light-sensitive mateial and the dye fixing material. However, the effects of the present invention are equally achieved in a case where a large amount of water than the above described amount is used to case where the above described desirable range of water is employed, except that it is accompanied the above described problem.

Since development by heating is utilized in the method of the present invention, the development can be conducted at a pH much lower than that of a layer at development of a so-called color diffusion transfer process wherein the development is carried out by spreading a developing solution in a film unit at around normal temperature (e.g., 25° C.). To elevate pH is rather disadvantageous because severe increase of fog is accompanied. Therefore, the pH of the layer at the heating for development and transfer of dyes is preferably 12 or less, and particularly preferably 11 or less.

On the other hand, when pH of the layer is too low, development by heating does not proceed. Thus, it is desired to maintain the pH in a certain high range, such as 7 or more. A pH of 8 or more is particularly preferred.

In the range of pH described above, images having low fog and a high density can be obtained in a short period time. The pH of a layer is determined by heating the light-sensitive material in the same manner as for development except light exposure, and, after allowing to cool to a normal temperature, droping 20 $\mu$l of water to the light-sensitive material and immediately bringing a pH electroded into contact with the light-sensitive material to measure a pH value under the equilibrium condition.

In the above described procedure, when the light-sensitive material and the dye fixing material are individually provided, the heating must be carried out by superimposing on each other. On the other hand, when the light-sensitive material and the dye fixing material are unified, it is heated as is. After the heating, the dye fixing material is separated from the light-sensitive material and the pH of the light-sensitive layer can measured in the above described manner.

A binder which forms a coated layer can be any of those capable of conducting water transfer. The coated layer may contain a light-sensitive silver halide, a dye providing substance, a mordant, an organic solvent having a high boiling point, etc. The relationship of the present invention is realized in the same manner when such additives are present.

The maximum swelling volume is obtained in the following manner. The light-sensitive material or the dye fixing material having a coated layer to be measured is immersed in water, and, after being sufficiently swollen, a length of a section of the material is measured by means of microscope, etc. to determine a thickness of the layer. The maximum swelling value is obtained by multiplying the thickness of the layer by the area of the coated layer of the light-sensitive material or the dye fixing material to be measured.

The method of measuring a degree of swelling is described in *Photographic Science and Engineering,* Vol. 16, page 449 (1972).

The degree of swelling is widely varied depending on the extent of hardening. Ordinarily, the extent of hardening is adjusted so that a thickness of layer at the maximum swelling is in a range from two to six times the thickness of the dry layer.

In the photographic light-sensitive material according to the present invention, the photographic emulsion layer and other hydrophilic colloid layers may contain an inorganic or organic hardener. It is possible to use a chromium salt (e.g., chromium alum, chromium acetate, etc.), an aldehyde (e.g., formaldehyde, glyoxal, glutaraldehyde, etc.), an N-methylol compound (e.g., dimethylolurea, methylol dimethylhydantoin, etc.), a dioxane derivative (e.g., 2,3-dihydroxydioxane, etc.), an active vinyl compound (e.g., 1,3,5-triacryloylhexahydro-s-triazine, 1,3-vinylsulfonyl-2-propanol, etc.), an active halogen compound (e.g., 2,4-dichloro-6-hydroxy-s-triazine, etc.), a mucohalogenic acid (e.g., mucochloric acid, mucophenoxychloric acid, etc.), etc., which are used individually or as a combination thereof.

The water described above can be supplied to the dye fixing layer or the light-sensitive layer. Alternatively, the water may be supplied to both the dye fixing material and the light-sensitive material.

In the present invention, water can be supplied by any method. For example, water may be supplied by a jet from a small hole or a web roller. Further, water may be supplied by rupture of a pod containing water. The method of supplying water is not restricted thereto. Moreover, water may be incorporated into the material in the form of water of crystallization or microcapsules.

The water which can be used in the present invention is not only limited to so-called "pure water" but also includes water which means water widely and customarily employed. Further, an aqueous solution containing a base and/or a base precursor as described hereinafter in addition to the above described peroxide or other intensifying agents can be used. Moreover, a mixture of a solvent having a low boiling point such as methanol, dimethylformamide, acetone, diisobutyl ketone, etc. with water can be used. Further, an aqueous solution containing a nucleophilic compound, a thermal solvent or a surface active agent as described hereinafter may be employed.

The reducing agent which is present at the time of heating can be incorporated into the light-sensitive material. Examples of the reducing agents include dye providing substances having reducing property as described hereinafter in addition to substances which are generally known as reducing agents in the field of art. Further, precursors of reducing agents which do not have reducing property themselves but exhibit reducing property due to action of nucleophilic reagent or heat in the process of development are also included.

Examples of the reducing agents which can be used in the present invention include an inorganic reducing agent such as sodium sulfite, sodium hydrogen sulfite, etc., a benzenesulfinic acid, a hydroxylamine, a hydrazine, a hydrazide, a boran-amide complex, a hydroquinone, an aminophenol, a catechol, a p-phenylenediamine, a 3-pyrazolidinone, a hydroxytetronic acid, an ascorbic acid, a 4-amino-5-pyrazolone, etc. The reducing agents as described in T. H. James, *The Theory of the Photographic Process,* Fourth Edition, pp. 291 to 334 (1977) can also employed. Further, reducing agent precursors as described in Japanese Patent Application (OPI) Nos. 138736/81 and 40245/82, U.S. Pat. No. 4,330,617, etc., may be employed.

Various combinations of developing agents as described in U.S. Pat. No. 3,039,869 can also be used.

In the present invention, an amount of the reducing agent added is from 0.01 mol to 20 mols per mol of silver, and more preferably from 0.1 mol to 10 mols, per mol of silver.

While heating, the maximum temperature of the light-sensitive material is decided by a boiling point of an aqueous solution (which is formed by dissolving various additives in water added) in the light-sensitive material, since the light-sensitive material contains a relatively large amount of water which acts as a solvent. The lowest temperature is preferably at 50° C. or more. The boiling point of water is 100° C. at atmospheric pressure and water is lost by evaporation when heated at 100° C. or more. Therefore, it is preferred to cover the surface of the light-sensitive material with a water-impermeable material or supply with vapor of high temperature and high pressure. It is advantageous that the temperature of the light-sensitive material is also increased due to the rise of the boiling point of aqueous solution in such cases.

As the heating means, a hot plate, an iron, a hot roller, an exothermic material utilizing carbon or titanium white, etc., or analogues thereof can be used.

The term "dye images" used in the present invention means multicolor and monocolor dye images. The monocolor dye images include monocolor images composed of a mixture of two or more dyes.

In accordance with the method of forming a dye image of the present invention, mobile (diffusible) dyes which are formed simultaneously with development in correspondence or countercorrespondence to silver images can be transferred to the dye fixing layer only by heating simultaneously with or after imagewise exposure of the light-sensitive material in the presence of a small amount of water.

The silver halide which can be used in the present invention may include any of silver chloride, silver bromide, silver iodide, silver chlorobromide, silver chloroiodide, silver iodobromide, and silver chloroiodobromide.

A halogen composition in the silver halide grains may be uniform, or the silver halide grains may have a multiple structure in which the composition is different between a surface portion and an inner portion (see Japanese Patent Application (OPI) Nos. 154232/82, 108533/83, 48755/84 and 52237/84, U.S. Pat. No. 4,433,048 and European Pat. No. 100,984, etc.).

Also, a tabular grain silver halide emulsion containing grains having a thickness of 0.5 μm or less, a diameter of at least 0.6 μm and an average aspect ratio of 5 or more (see U.S. Pat. Nos. 4,414,310 and 4,435,499, and West German Patent Application (OLS) No. 3,241,646A1, etc.), and a monodispersed emulsion having a nearly uniform distribution of grain size (see Japanese Patent Application (OPI) Nos. 178235/82, 100846/83 and 14829/83, PCT Application (OPI) No. 83/02338A1, and European Patents 64,412A3 and 83,377A1, etc.) may be used in the present invention.

Two or more kinds of silver halides in which a crystal habit, a halogen composition, a grain size and/or a distribution of grain size, etc. are different from each other may be used in mixture. Further, two or more kinds of monodispersed emulsions having different grain size from each other may be employed in mixture to control gradation.

An average grain size of the silver halide used in the present invention is preferably from 0.001 μm to 10 μm, and more preferably from 0.001 μm to 5 μm.

These silver halide emulsions can be prepared by any of an acid process, a neutral process, and an ammonia process. Further, a reaction system of soluble silver salts and soluble halogen salts may be any of a single jet process, a double jet process and a combination thereof. In addition, a reverse mixing process in which silver halide grains are formed in the presence of an excess of silver ions, or a controlled double jet process in which the pAg in the liquid phase is kept constant, can also be utilized.

Moreover, for the purpose of increasing growth of grains, a concentration of addition, the amount of addition and/or speed of addition of silver salts and halogen salts added may be raised (see Japanese Patent Application (OPI) Nos. 142329/80 and 158124/80, and U.S. Pat. No. 3,650,757, etc.).

Furthermore, silver halide grains of epitaxial junction type (see Japanese Patent Application (OPI) No. 16124/81, and U.S. Pat. No. 4,094,684, etc.) may be employed.

In the step for formation of silver halide grains used in the present invention, ammonia, an organic thioether derivative as described in Japanese Patent Publication No. 11386/72, or a compound containing sulfur as described in Japanese Patent Application (OPI) No. 144319/78, etc., can be used as a solvent for silver halide.

In a process of the formation or physical ripening of silver halide grains, a cadmium salt, a zinc salt, a lead salt, or a thallium salt, etc., may coexist. These salts are used for the purposes of improving a change in photographic performance against the pressure, etc. Further, for the purpose of eliminating high-intensity reciprocity failure or low-intensity reciprocity failure, a water-soluble iridium salt such as iridium (III or IV) chloride, ammonium hexachloroiridiate, etc. or a water-soluble rhodium salt such as rhodium chloride, etc., can be used.

Soluble salts may be removed from the silver halide emulsion after precipitate formation or physical ripening, and a noodle washing process or a flocculation process can be used for this purpose.

While the silver halide emulsion may be employed without being subjected to after-ripening, it is usually chemically sensitized. For the chemical sensitization, a sulfur sensitization method, a reduction sensitization method, and a noble metal sensitization method, etc., which are known in the field of emulsions for conventional type photographic light-sensitive materials can be applied alone or in combination therewith. Such a chemical sensitization may be carried out in the presence of a nitrogen-containing heterocyclic compound (see Japanese Patent Application (OPI) Nos. 126526/83 and 215644/83, etc.).

The silver halide emulsion used in the present invention can be that of a surface latent image type in which a latent image is formed mainly on the surface of grains, or that an internal latent image type in which a latent image is formed mainly in the interior of grains. Further, a direct reversal emulsion in which an internal latent image type emulsion and a nucleating agent are used in combination may be used. Examples of the internal latent image type emulsions suitable for this purpose are described in U.S. Pat. Nos. 2,592,250 and 3,761,276, Japanese Patent Publication No. 3534/83, and Japanese Patent Application (OPI) No. 136641/82, etc. Preferred examples of the nucleating agents suitably used in the present invention are described in U.S. Pat. Nos. 3,227,552, 4,245,037, 4,255,511, 4,266,031 and 4,276,364, and West German Patent Application (OLS) No. 2,635,316, etc.

The coating amount of the light-sensitive silver halide used in the present invention is generally in a range of from 1 mg/m$^2$ to 10 g/m$^2$, calculated as an amount of silver.

In the present invention, an organic metal salt which is relatively stable to light is used as an oxidizing agent together with the light-sensitive silver halide. In this case, it is necessary that the light-sensitive silver halide and the organic metal salt are present in a contact state or in a close relation. Of these organic metal salts, an organic silver salt is particularly preferably used.

The organic metal salt is effective, when the heat-developable light-sensitive material is developed by heating at a temperature of 50° C. or more, and preferably 60° C. or more.

Examples of organic compounds which can be used for forming the above-described organic silver salt oxidizing agent include an aliphatic or aromatic carboxylic acid, a compound containing a mercapto group or a thiocarbonyl group having an α-hydrogen atom, and a compound containing an imino group, etc.

Typical examples of the silver salts of aliphatic carboxylic acids include a silver salt derived from behenic acid, stearic acid, oleic acid, lauric acid, capric acid, myristic acid, palmitic acid, maleic acid, fumaric acid, tartaric acid, Freund's acid, linolic acid, linoleic acid, adipic acid, sebacic acid, succinic acid, acetic acid, butyric acid, propiolic acid, and camphoric acid. Also, a silver salt derived from such an aliphatic carboxylic acid substituted with a halogen atom or a hydroxyl group, or an aliphatic carboxylic acid having a thioether group, etc., can be used.

Typical examples of the silver salts of aromatic carboxylic acids and other carboxyl group-containing compounds include a silver salt derived from benzoic acid, 3,5-dihydroxybenzoic acid, o-methylbenzoic acid, m-methylbenzoic acid, p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, and 3-carboxymethyl-4-methyl-4-thiazolin-2-thione, etc.

Examples of the silver salts of compounds containing a mercapto group or a thiocarbonyl group include a silver salt derived from 3-mercapto-4-phenyl-1,2,4-triazole, 2-mercaptobenzimidazole, 2-mercapto-5-aminothiadiazole, 2-mercaptobenzothiazole, an S-alkyl thioglycolic acid (wherein the alkyl group has from 12 to 22 carbon atoms), a dithiocarboxylic acid such as dithioacetic acid, etc., a thioamide such as thiostearoylamide, etc., 5-carboxyl-1-methyl-2-phenyl-4-thiopyridine, and a mercapto compound such as mercaptotriazine, 2-mercaptobenzoxazole, mercaptooxadiazole, or 3-amino-5-benzylthio-1,2,4-triazole, etc., as described in U.S. Pat. No. 4,123,274, etc.

Typical examples of the silver salts of compounds containing an imino group include a silver salt derived from a benzotriazole or a derivative thereof as described in Japanese Patent Publication Nos. 30270/69 and 18416/70, for example, benzotriazole, an alkyl-substituted benzotriazole such as methylbenzotriazole, etc., a halogen-substituted benzotriazole such as 5-chlorobenzotriazole, etc., a carboimidobenzotriazole such as butylcarboimidobenzotriazole, etc., a nitrobenzotriazole as described in Japanese Patent Application (OPI) No. 118639/83, sulfobenzotriazole, carboxybenzotriazole or a salt thereof, hydroxybenzotriazole, etc., as described in Japanese Patent Application (OPI) No. 118638/83, a 1,2,4-triazole or a 1H-tetrazole as described in U.S. Pat. No. 4,220,709, a carbazole, a saccharin, an imidazole and a derivative thereof, etc.

Moreover, a silver salt as described in *Research Disclosure,* RD No. 17029 (June, 1978), an organic metal salt other than a silver salt, such as copper stearate, etc., and a silver salt of a carboxylic acid having an alkyl group such as phenylpropiolic acid, etc. as described in Japanese Patent Application No. 221535/83 are also used in the present invention.

The organic silver salt described above can be employed in a range from 0.01 mol to 10 mols and preferably from 0.01 mol to 1 mol, per mol of the light-sensitive silver halide. The total coating amount of the light-sensitive silver halide and the organic silver salt is suitably from 50 mg/m$^2$ to 10 g/m$^2$.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, stytyl dyes, and hemioxonol dyes. Of these dyes, cyanine dyes, merocyanine dyes and complex merocyanine dyes are particularly useful. Any conventionally utilized nucleus for cyanine dyes is applicable to these dyes as a basic heterocyclic nucleus. That is, a pyrroline nucleus, an oxazoline nucleus, a thiazole nucleus, a selenazole nucleus, an imidazole nucleus, a tetrazole nucleus, a pyridine nucleus, etc., and further, nuclei formed by condensing an alicyclic hydrocarbon ring with these nuclei and nuclei formed by condensing an aromatic hydrocarbon ring with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combinations thereof. A combination of sensitizing dyes is often used, particularly for the purpose of supersensitization.

The sensitizing dyes may be present in the emulsion together with dyes which themselves do not give rise to spectrally sensitizing effects but which exhibit a supersensitizing effect or materials which do not substantially absorb visible light but which exhibit a supersensitizing effect. For example, aminostilbene compounds substituted with a nitrogen-containing heterocyclic group (for example, those described in U.S. Pat. Nos. 2,993,390 and 3,635,721, etc.) aromatic organic acid-formaldehyde condensates (for example, those described in U.S. Pat. No. 3,743,510, etc.), cadmium salts, azaindene compounds, etc., can be present. The combinations as described in U.S. Pat. Nos. 3,615,613, 3,615,641, 3,617,295 and 3,635,721 are particularly useful.

In order to incorporate the sensitizing dye into a silver halide photographic emulsion, it may be directly dispersed in the silver halide emulsion or it may be dissolved in a solvent such as water, methanol, ethanol, acetone, methyl cellosolve, etc., individually or as a mixture thereof, and then the solution is added to the silver halide emulsion. Further, the sensitizing dye is dissolved in a solvent which is substantially immiscible with water such as phenoxyethanol, etc., the solution is then dispersed in water or a hydrophilic colloid and thereafter the dispersion is added to the silver halide emulsion. Moreover, the sensitizing dye is mixed with an oleophilic compound such as a dye providing compound, etc., and added simultaneously to the silver halide emulsion.

In the case of using a combination of the sensitizing dyes, these sensitizing dyes may be separately dissolved or a mixture thereof may be dissolved. Furthermore, these sensitizing dyes may be added separately or simultaneously as a mixture to the silver halide emulsion. They may be added together with other additives to the emulsion.

The period for the addition of the sensitizing dye to the silver halide emulsion may be before, during, or after the chemical ripening, or before, during or after the formation of silver halide grains as described in U.S. Pat. Nos. 4,183,756 and 4,225,666.

The amount added is generally in a range from about $10^{-8}$ mol to about $10^{-2}$ mol per mol of silver halide.

In the present invention, the light-sensitive material contains a compound which forms a mobile dye or releases a mobile dye in correspondence or counter-correspondence to the reaction wherein the light-sensitive silver halide is reduced to silver under a high temperature condition, that is, a dye providing substance.

In the following, the dye providing substance is described in detail.

An examaple of the dye providing substance which can be used in the present invention is a coupler capable of reacting with a developing agent (reducing agent). A method utilizing such a coupler can form a dye upon a reaction of the coupler with an oxidation product of a developing agent which is formed by an oxidation reduction reaction between the silver salt and the developing agent and is described in many literatures. Specific examples of the developing agents and the couplers are described in greater detail, for example, in T. H. James, *The Theory of the Photographic Process,* Fourth Edition, pp. 291 to 334 and pp. 354 to 361, MacMillan Publishing Co., 1977; Shinichi Kikuchi, *Shashin Kagaku* (Photographic Chemistry), Fourth Edition, pp. 284 to 295, Kyoritsu Shuppan Co., Ltd., 1977.

Another example of the dye providing substance is a dye-silver compound in which an organic silver salt is connected to a dye. Specific examples of the dye-silver compounds are described in *Research Disclosure,* RD No. 16966, pp. 54 to 58 (May, 1978), etc.

Still another example of the dye providing substance is an azo dye used in a heat-developable silver dye bleaching process. Specific examples of the azo dyes and the method for bleaching are described in U.S. Pat. No. 4,235,957, *Research Disclosure,* No. 14433, pp. 30 to 32 (April, 1976), etc.

A further example of the dye providing substance is a leuco dye as described in U.S. Pat. Nos. 3,985,565 and 4,022,617, etc.

A still further example of the dye providing substance is a compound having a function of imagewise releasing a diffusible dye.

This type of compound can be represented by formula (LI)

$$(\text{Dye-X})_n\text{-Y} \qquad \text{(LI)}$$

wherein Dye represents a dye moiety or a dye precursor moiety; X represents a chemical bond or a connecting group; Y represents a group having a property such that diffusibility of the compound represented by $(\text{Dye-X})_n$-Y can be differentiated in correspondence or counter-correspondence to light-sensitive silver salts having a latent image distributed imagewise or a group having a property of releasing Dye in correspondence or counter-correspondence to light-sensitive silver salts having a latent image distributed imagewise, diffusibility of Dye released being different from that of the compound represented by $(\text{Dye-X})_n$-Y; and n represents 1 or 2 and when n is 2, the two Dye-X groups are the same or different.

Specific example of the dye providing substance represented by formula (LI) include, for example, dye developers in which a hydroquinone type developing agent (reducing agent) is connected to a dye component are described in U.S. Pat. Nos. 3,134,764, 3,362,819, 3,597,200, 3,544,545 and 3,482,972, etc. Further, substances capable of releasing diffusible dyes upon an intramolecular nucleophilic displacement reaction are described in Japanese Patent Application (OPI) No. 63618/76, etc., and substances capable of releasing diffusible dyes upon an intramolecular rearrangement reaction of an isooxazolone ring are described in Japanese Patent Application (OPI) No. 111628/74, etc.

In any of these processes, diffusible dyes are released in portions where development does not occur. In contrast, in portions where development occurs neither release nor diffusion of dyes take place.

There has been provided a process in which a dye releasing compound is preliminarily converted to an oxidized form thereof which does not have a dye releasing ability, the oxidized form of the compound is coexistent with a reducing agent or a precursor thereof, and after development the oxidized form is reduced with the remaining reducing agent which is not oxidized to release a diffusible dye. Specific examles of dye providing substances which can be used in such a process are described in Japanese Patent Application (OPI) Nos. 110827/78, 130927/79, 164342/81, and 35533/78, etc.

On the other hand, substances capable of releasing diffusible dyes in portions where development occurred are also know. For example, substances capable of releasing diffusible dyes in the releasing groups thereof with oxidation products of developing agents (reducing agents) are described in British Pat. No. 1,330,524, Japanese Patent Publication No. 39165/73, U.S. Pat. No. 3,443,940, etc., and substances capable of forming diffusible dyes upon a reaction of couplers having diffusion resistant groups in the releasing groups thereof with oxidation products of developing agents are described in U.S. Pat. No. 3,227,550, etc.

In these processes using color developing agents, there is a severe problem in that images are contaminated with oxidation decomposition products of the developing agents. Therefore, in order to eliminate such a problem, dye releasing compounds which have reducing property themselves and thus do not need the use of developing agents have been proposed. (As a matter of course, the above-described reducing agents may be auxiliary used.) Typical examples of these dye releasing compounds are illustrated together with the relevant literatures in the following. The definitions for the substituents of the general formulae set forth below are the same as those described in the cited literatures, respectively.

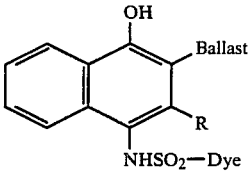

U.S. Pat. No. 3,928,312, etc.

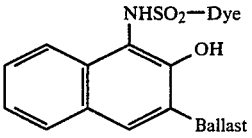

U.S. Pat. No. 4,053,312, etc.

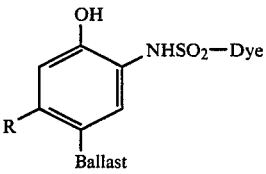

U.S. Pat. No. 4,055,428, etc.

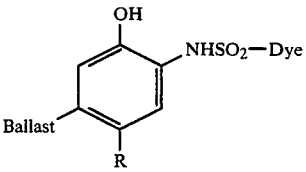

U.S. Pat. No. 4,336,322

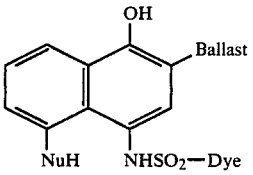

Japanese Patent Application (OPI) No. 65839/84

-continued

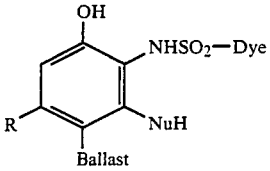

Japanese Patent Application (OPI) No. 65839/84

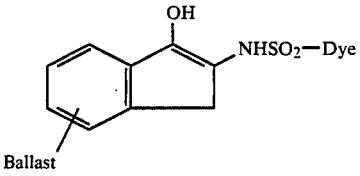

U.S. Pat. No. 4,149,892

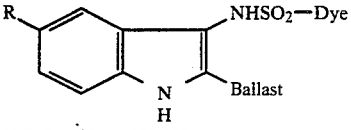

U.S. Pat. No. 4,198,235

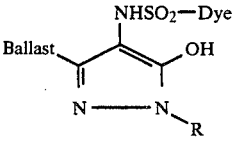

U.S. Pat. No. 4,198,235

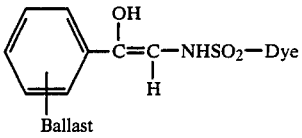

U.S. Pat. No. 4,198,235

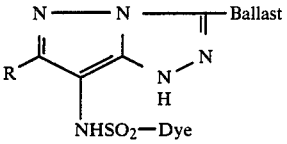

Research Disclosure, RD No. 17465 (Oct., 1978)

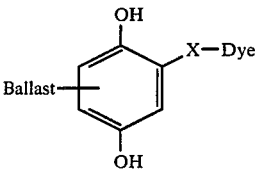

U.S. Pat. No. 3,725,062

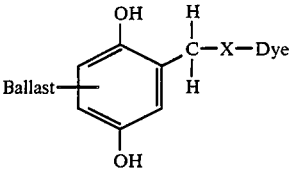

U.S. Pat. No. 3,728,113

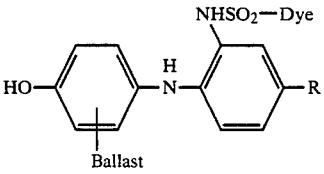

-continued

U.S. Pat. No. 3,443,939

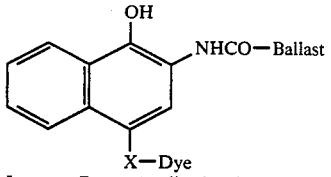

Japanese Patent Application (OPI) No. 116537/78

Among the dye providing substasnces which act as reducing agents and release a mobile dye used in the present invention, preferred are those represented by formula (LII)

$$IR—SO_2—D \quad (LII)$$

wherein IR represents a reducing group having a property of releasing a dye by cleavage in correspondence or countercorrespondence to light-sensitive silver halide having a latent image distributed imagewise, diffusibility of the dye thus released being different from that of the dye providing substance represented by formula (LII); and D represents a mobile image forming dye (including a precursor thereof) moiety which may include a connecting group which bonds a "pure" dye moiety to the $SO_2$ group.

Preferably the reducing group (IR) in the dye providing substance $IR—SO_2—D$ has an oxidation reduction potential with respect to a saturated calomel electrode of 1.2 V or less when measuring the polarographic half wave potential using acetonitrile as a solvent and sodium perchlorate as a base electrolyte.

Specific examples of the reducing group represented by IR include various groups as described in U.S. Pat. No. 4,473,631. Among them, preferred are groups represented by formula (LIII)

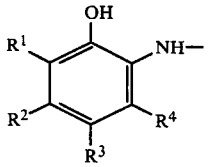

(LIII)

wherein $R^1$, $R^2$, $R_3$, and $R^4$ each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group, and an arylthio group.

The alkyl moiety and the aryl moiety in the above described substituents may be further substituted with an alkoxy group, a halogen atom, a hydroxyl group, a cyano group, an acyl group, an acylamino group, a substituted carbamoyl group, a substituted sulfamoyl group, an alkylsulfonylamino group, an arylsulfonylamino group, a substituted ureido group or a carboalkoxy group.

Furthermore, the hydroxyl group and the amino group included in the reducing group represented by IR may be protected by a protective group which is reproducible by the action of a nucleophilic reagent.

In more preferred embodiments of the present invention, the reducing group IR is represented by formula (LIV)

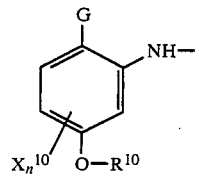

(LIV)

wherein G represents a hydroxyl group or a group providing a hydroxyl group upon hydrolysis; $R^{10}$ represents an alkyl group or an aromatic group; n represents an integer of 1 to 3; $X^{10}$ represents an electron donating substituent when n is 1, or substituents which are the same or different one of the substituents being an electron donating group and the second or second and third substituents being selected from an electron donating group or a halogen atom when n is 2 or 3, respectively; or one or more of the $X^{10}$ groups form a condensed ring with each other or with $—OR^{10}$; and the total number of the carbon atoms included in $R^{10}$ and $X^{10}$ is 8 or more.

Of the reducing groups represented by the general formula (LIV), more preferred reducing groups IR are represented by formulae (LIVa)

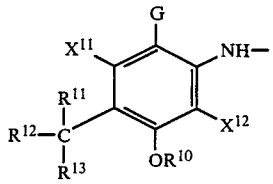

(LIVa)

wherein G represents a hydroxyl group or a group providing a hydroxyl group upon hydrolysis; $R^{11}$ and $R^{12}$, which may be the same or different, each represents an alkyl group, or $R^{11}$ and $R^{12}$ together form a ring; $R^{13}$ represents a hydrogen atom or an alkyl group; $R^{10}$ represents an alkyl group or an aromatic group; $X^{11}$ and $X^{12}$ (which may be the same or different) each represents a hydrogen atom, an alkyl group, an alkoxy group, a halogen atom, an acylamino group, or an alkylthio group; or $R^{10}$ and $X^{12}$, or $R^{10}$ and $R^{13}$ together from a ring; or by formula (LIVb)

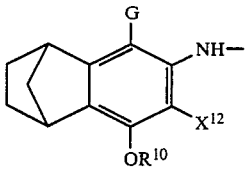

(LIVb)

wherein G represents a hydroxyl group or a group providing a hydroxyl group upon hydrolysis; $R^{10}$ represents an alkyl group or an aromatic group; $X^{12}$ represents a hydrogen atom, an alkyl group, an alkoxy group, a halogen atom, an acylamino group or an alkylthio group; or $R^{10}$ and $X^{12}$ together form a ring.

Specific examples of the reducing groups represented by formulae (LIV), (LIVa), and (LIVb) are described in U.S. Pat. No. 4,055,428, Japanese Patent Application (OPI) Nos. 12642/81 and 16130/81, respectively.

In still another more preferred embodiments of the present invention, the reducing group IR is represented by formula (LV)

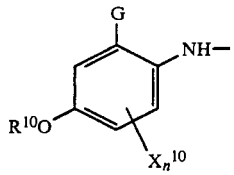

(LV)

where G, $R^{10}$, $X^{10}$, and n each has the same meaning as defined in formula (LIV).

Of the reducing groups represented by formula (LV), more preferred reducing groups IR are represented by formulae (LVa)

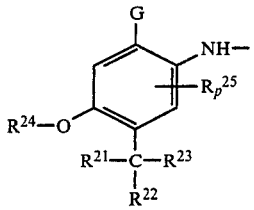

(LVa)

wherein G represents a hydroxyl group or a group providing a hydroxyl group upon hydrolysis; $R^{21}$ and $R^{22}$, which may be the same or different, each represents an alkyl group or an aromatic group, and $R^{21}$ and $R^{22}$ may be bonded to each other to form a ring; $R^{23}$ represents a hydrogen atom, an alkyl group or an aromatic group; $R^{24}$ represents an alkyl group or an aromatic group; $R^{25}$ represents an alkyl group, an alkoxy group, an alkylthio group, an arylthio group, a halogen atom or an acylamino group; p is 0, 1, or 2; or $R^{24}$ and $R^{25}$ may be bonded to each other to form a condensed ring; $R^{21}$ and $R^{24}$ may be bonded to each other to form a condensed ring; or $R^{21}$ and $R^{25}$ may be bonded to each other to form a condensed ring; and the total number of the carbon atoms included in $R^{21}$, $R^{22}$, $R^{23}$, $R^{24}$, and $R_p^{25}$ is more than 7; by formula (LVb)

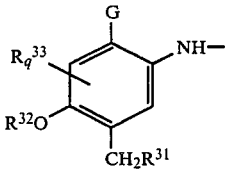

(LVb)

wherein G represents a hydroxyl group or a group providing a hydroxyl group upon hydrolysis; $R^{31}$ represents an alkyl group or an aromatic group; $R^{32}$ represents an alkyl group or an aromatic group; $R^{33}$ represents an alkyl group, an alkoxy group, an alkylthio group, an arylthio group, a halogen atom, or an acylamino group; q is 0, 1, or 2; or $R^{32}$ and $R^{33}$ together form a condensed ring; $R^{31}$ and $R^{32}$ together form a condensed ring; or $R^{31}$ and $R^{33}$ together form a condensed ring; and the total number of carbon atoms included in $R^{31}$, $R^{32}$, and $R_q^{33}$ is more than 7; or by formula (LVc)

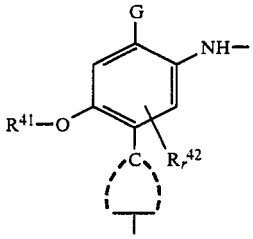

(LVc)

wherein G represents a hydroxyl group or a group providing a hydroxyl group upon hydrolysis; $R^{41}$ represents an alkyl group or an aromatic group; $R^{42}$ represents an alkyl group, an alkoxy group, an alkylthio group, an arylthio group, a halogen atom or an acylamino group; r is 0, 1 or 2; the group of

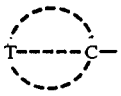

represents a group in which 2 to 4 saturated hydrocarbon rings are condensed, the carbon atom

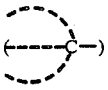

in the condensed ring which is connected to the phenyl nucleus (or a precursor thereof), is a tertiary carbon atom which composes one of the pivot of the condensed ring, one or more of the carbon atoms, excluding the tertiary carbon atom in the hydrocarbon ring may be substituted for oxygen atoms, or the hydrocarbon ring may have a substituent or may be further condensed with the aromatic ring; $R^{41}$ or $R^{42}$ and the group of

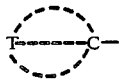

may be bonded to each other to form a condensed ring; and the total number of the carbon atoms included in $R^{41}$, $R_r^{42}$, and the group

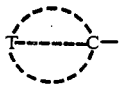

is 7 or more.

The dye moiety represented by Dye or D in the above described formula is preferably derived from azo dyes, azomethine dyes, anthraquinone dyes, naphthoquinone dyes, styryl dyes, nitro dyes, quinoline dyes, carbonyl dyes, and phthalocyanine dyes. Further, the dye moiety may be used in a form temporarily shifted to a shorter wavelength region or in the form of a precursor. Specific examples of the dye moieties released from the dye providing compounds include those described in the above-mentioned U.S. Pat. No. 4,473,631, and the chelated dyes as described in Japanese Patent Application (OPI) No. 35533/78.

Any of various dye providing substances described above can be employed in the present invention.

Specific examples of image forming substances used in the present invention are described in the patents and literature mentioned hereinbefore.

The dye providing substance and oil soluble additives such as the image forming accelerator described below, etc., used in the present invention can be introduced into a layer of the light-sensitive material by known methods, such as the method as described in U.S. Pat. No. 2,322,027. In this case, an organic solvent having a high boiling point or an organic solvent having a low boiling point as described below can be used. For example, the dye providing substance, etc., is dispersed in a hydrophilic colloid after being dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, diotylbutyl phosphate, etc.), a citric acid ester (for example, tributyl acetylcitrate, etc.), a benzoic acid ester (for example, octyl benzoate, etc.), an alkylamide, a fatty acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetage, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance, etc. is dispersed in a hydrophilic colloid. For this purpose, the surface active agents illustrated in other part of the specification can be used.

An amount of the organic solvent having a high boiling point used in the present invention is 10 g or less, and preferably 5 g or less, per g of the dye providing substance used.

In case of using compounds which are substantially water-insoluble, they may be incorporated in the light-sensitive material by dispersing as fine particles in a binder, in addition to the above described methods.

In the present invention, an image formation accelerator can be used. The image formation accelerator has a function which accelerates the oxidation reduction reaction between a silver salt oxidizing agent and a reducing agent, a function which accelerates a reaction of forming a dye, decomposing a dye or releasing a mobile dye from a dye providing substance, etc., or a function which accelerates transfer of a dye from a layer of the light-sensitive material to a dye fixing layer. From the standpoint of a physical or chemical function, they are classified into a group, for example, a base or base precursor, a nucleophilic compound, an oil, a thermal solvent, a surface active agent, a compound having an interaction with silver or a silver ion, etc. However, such groups of substances usually show complex functions and generally show several some of the above described accelerating effects at the same time.

The image formation accelerators are classified depending on their function and specific examples thereof are set forth below. However, such a classification is only for convenience, and, as noted above, in practice a compound may often have multiple function.

(a) Base

Examples of preferred bases include an inorganic base, for example, a hydroxide, a secondary or tertiary phosphate, a borate, a carbonate, a quinolinate or a metaborate of an alkali metal or an alkaline earth metal, ammonium hydroxide, a hydroxide of a quaternary alkylammonium, a hydroxide of other metals, etc., and an organic base, for example, an aliphatic amine (such as a trialkylamine, a hydroxylamine, an aliphatic polyamine, etc.), an aromatic amine (such as an N-alkyl substituted aromatic amine, an N-hydroxyalkyl substituted aromatic amine, a bis[p-(dialkylamino)phenyl]methane, etc.), a heterocyclic amine, an amidine, a cyclic amidine, a quanidine, a cyclic quanidine, etc. Among them, those having pKa of 8 or more are particularly preferred.

Also, a salt of the above described organic base and a weak acid, for example, a carbonate, a hydrogen carbonate, a borate, a secondary or tertiary phosphate, a quinolinate, a metaborate, etc., is preferably used. Furthermore, the compounds as described in Japanese Patent Application (OPI) No. 218443/84 are preferably employed.

(b) Base precursor

As a base precursor, a substance which releases a base upon a reaction by heating, for example, a salt of an organic acid and a base which decomposes by heating with decarboxylation, a compound which releases an amine upon decomposition with an intramolecular nucleophilic displacement reaction, a Lossen rearrangement reaction or a Beckmann rearrangement reaction, etc., or a compound which generates a base by electrolysis, etc., are preferably employed.

Examples of preferred former type base precursors which release a base by heating include a salt of trichloroacetic acid as described in British Pat. No. 998,949, etc., a salt of α-sulfonylacetic acid as described in U.S. Pat. No. 4,060,420, a salt of a propiolic acid as described in Japanese Patent Application (OPI) No. 180537/84, a 2-carboxycarboxamide derivative as described in U.S. Pat. No. 4,088,496, a salt of a thermally decomposable acid using, in addition to an organic base, an alkali metal or an alkaline earth metal as a base component as described in Japanese Patent Application (OPI) No. 195237/84, a hydroxamecarbamate utilizing a Lossen rearrangement as described in Japanese Patent Application (OPI) No. 168440/84, an aldoximecarbamate which forms a nitrile upon heating as described in Japanese Patent Application (OPI) No. 157637/84, etc. Further, base precursors as described in British Pat. No. 998,945, U.S. Pat. No. 3,220,846, Japanese Patent Application (OPI) No. 22625/75, and British Pat. No. 2,079,480, etc., are useful.

Examples of compounds which generate a base by electrolysis using electrolytic oxidation include various salts of fatty acids. According to such a reaction, carbonates of alkali metals or organic bases such as a quanidine, an amidine, etc., can be obtained in extremely high efficiency.

Further, methods using electrolytic reduction include a method for forming an amine by reduction of a nitro or nitroso compound; a method for forming an amino by reduction of nitrile; a method for forming a p-aminophenol, a p-phenylenediamine, a hydrazine, etc., by reduction of a nitro compound, an azo compound, an azoxy compound, etc.; or the like. The p-aminophenols, p-phenylenediamines, and hydrazines can be employed not only as bases but also directly as color image forming substances.

Moreover, it is naturally utilized that alkali components are generated by electrolysis of water in the presence of various inorganic salts.

(c) Nucleophilic compound

Examples of the nucleophilic compounds include water, a water releasing compound, an amine, an amidine, a quanidine, a hydroxylamine, a hydrazine, a hydrazide, an oxime, a hydroxamic acid, a sulfonamide, an active methylene compound, an alcohol, a thiol, etc. Further, salts or precursors of the above described compounds may be employed.

(d) Oil

An organic solvent having a high boiling point (so-called plasticizer) which can be used as a solvent for dispersion of a hydrophobic compound is employed.

(e) Thermal solvent

The thermal solvent is a compound which is solid at an ambient temperature, but melts at a desired development temperature to act as a solvent. Examples of the thermal solvents include compounds which are selected from a urea, a urethane, an amide, a pyridine, a sulfonamide, a sulfone, a sulfoxide, an ester, a ketone and an ether and which are solid at 40° C. or below.

(f) Surface active agent

Examples of the surface active agents include a pyridinium salt, an ammonium salt, and a phosphonium salt as described in Japanese Patent Spplication (OPI) No. 74547/84, etc., and a polyalkylene oxide as described in Japanese Patent Application (OPI) No. 57231/84, etc.

(g) Compound having an interaction with silver or a silver ion

Examples of such compounds include an imide, a nitrogen-containing heterocyclic compound as described in Japanese Patent Application (OPI) No. 177550/84, a thiol, a thiourea, and a thioether as described in Japanese Patent Application (OPI) No. 111636/84, etc.

The image formation accelerator may be incorporated into either a light-sensitive material or a dye fixing material, or both of them. Further, it may be incorporated into any of an emulsion layer, an intermediate layer, a protective layer, an image receiving layer (a dye fixing layer) and a layer adjacent thereto. The above descriptions are true in an embodiment wherein a light-sensitive layer and a dye fixing layer are provided on the same support.

The image formation accelerators may be employed individually or in a mixture of two or more thereof. In general, a great accelerating effect is obtained when two or more kinds thereof are employed in mixture. Particularly, when a base or base precursor is employed together with other kinds of the accelerators, a remarkable accelerating effect is revealed.

In the present invention, various kinds of development stopping agents are used for the purpose of obtaining a constant image irrespective of variation in a processing temperature and a processing time at the development.

The term "development stopping agent" used herein means a compound which can rapidly neutralize a base or react with a base to decrease concentration of the base in the layer when the development has appropriately proceeded whereby the development is stopped or a compound which can interact with silver or a silver salt and inhibit the development.

Examples of the development stopping agents include an acid percursor which releases an acid by heating, an electrophilic compound which causes a displacement reaction with a base coexistent by heating, a nitrogen-containing heterocyclic compound, a mercapto compound, and a precursor thereof, etc.

Examples of the acid precursors include an oxime ester as described in Japanese Patent Application (OPI) Nos. 108837/85 and 192939/85, a compound which releases an acid upon a Lossen rearrangement as described in Japanese Patent Application (OPI) No. 230133/85, etc.

Examples of the electrophilic compounds which cause a displacement reaction with bases by heating include a compound as described in Japanese Patent Application (OPI) No. 230134/85, etc.

Further, the compounds which release a mercapto compound by heating are useful and include those described in U.S. patent application Ser. Nos. 774,427 (filed Sept. 10, 1985), 809,627 (filed Dec. 16, 1985), 799,996 (filed Nov. 20, 1985), 827,139 (filed Feb. 7, 1986), 829,032 (filed Feb. 13, 1986), 828,481 (filed Feb. 12, 1986) and 830,031 (filed Feb. 18, 1986), Japanese Patent Application (OPI) No. 53632/86, etc.

It is preferred that the above described development stopping agent is employed together with the base precursor since its effect is particularly achieved.

In such a case, the ratio (molar ratio) of base precursor/acid precursor is preferably in a range from 1/20 to 20/1, and more preferably in a range from 1/5 to 5/1.

Further, in the present invention, it is possible to use a compound which activates development simultaneously while stabilizing the image. Particularly, it is preferred to use an isothiuronium including 2-hydroxyethylisothiuronium trichloroacetate, etc., as described in U.S. Pat. No. 3,301,678, a bis(isothiuronium) including 1,8-(3,6-dioxaoctane) bis(isothiuronium trichloroacetate), etc., as described in U.S. Pat. No. 3,669,670, a thiol compound as described in West German Patent Application (OLS) No. 2,162,714, a thiazolium compound such as 2-amino-2-thiazolium trichloroacetate, 2-amino-5-bromoethyl-2-thiazolium trichloroacetate, etc., as described in U.S. Pat. No. 4,012,260, a compound having an α-sulfonylacetate as an acidic component, such as bis(2-amino-2-thiazolium)methylenebis(-sulfonylacetate), 2-amino-2-thiazolium phenylsulfonylacetate, etc., as described in U.S. Pat. No. 4,060,420, etc.

Moreover, an azole thioether and a blocked azolinethione compound as described in Belgian Pat. No. 768,071, a 4-aryl-1-carbomyl-2-tetrazolin-5-thione compound as described in U.S. Pat. No. 3,893,859, and a compound as described in U.S. Pat. Nos. 3,839,041, 3,844,788 and 3,877,940 are also preferably employed.

In the present invention, various kinds of antifogging agents can be employed. Examples of useful antifogging agents include an azole, a carboxylic acid and a phosphoric acid each containing a nitrogen atom as described in Japanese Patent Application (OPI) No.

168442/84, a mercapto compound and a metal salt thereof as described in Japanese Patent Application (OPI) No. 111636/84, etc. Such an antifogging agent is generally used in a concentration range from 0.001 mol to 10 mols per mol of silver.

In the present invention, image toning agents can be incorporated, if desired. Effective toning agents are compounds such as phthaladinones, 1,2,4-triazoles, 1H-tetrazoles, thiouracils and 1,3,4-thiadiazoles, etc. Examples of preferred toning agents include 5-amino-1,3,4-thiadiazole-2-thiol, 3-mercapto-1,2,4-triazole, bis(dimethylcarbamyl)disulfide, 6-methylthiouracil and 1-phenyl-2-tetrazolin-5-thione, etc. Particularly effective toning agents are compounds which can form black images.

The concentration of the toning agents incorporated varies according to the kind of heat-developable light-sensitive material, processing conditions, images to be required, and other factors, but it is generally in a range of from about 0.001 mol to 0.1 mol per mol of silver in the light-sensitive material.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, a protein such as gelatin, a gelatin derivative, a cellulose derivative, etc., a polysaccharide such as starch, gum arabic, etc., and a synthetic polymer compound, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

In addition, the compounds as described in *Research Disclosure,* page 26, IXA (December, 1978) can be so employed.

A suitable coating amount of the binder according to the present invention is generally 20 g/m$^2$ or less, preferably 10 g/m$^2$ or less, and more preferably 7 g/m$^2$ or less.

A suitable ratio of the organic solvent having a high boiling point which is dispersed in a binder together with a hydrophobic compound such as a dye providing substance to the binder is 1 ml or less, preferably 0.5 ml or less, and more preferably 0.3 ml or less, per g of the binder.

In the heat-developable light-sensitive material and the dye fixing material according to the present invention, the photographic emulsion layer, the above described electrically conductive layer, the dye fixing layer and other binder layers may contain an inorganic or organic hardener. It is possible to use a chromium salt (e.g., chromium alum, chromium acetate, etc.), an aldehyde (e.g., formaldehyde, glyoxal, glutaraldehyde, etc.), an N-methylol compound (e.g., dimethylolurea, methylol dimethylhydantoin, etc.), a dioxane derivative (e.g., 2,3-dihydroxydioxane, etc.), an active vinyl compound (e.g., 1,3,5-triacryloylhexahydro-s-triazine, 1,3-vinylsulfonyl-2-propanol, 1,2-bis(vinylsulfonylacetamide)ethane, etc.), an active halogen compound (e.g., 2-4-dichloro-6-hydroxy-1,3,5-triazine, etc.), a mucohalogenic acid (e.g., mucochloric acid, mucophenoxychloric acid, etc.), etc., which are used individually or as a combination thereof.

A support used in the heat-developable light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a resin material may be used. Further, a paper support laminated with a polymer such as polyethylene, etc., can be used. Polyesters as described in U.S. Pat. Nos. 3,634,089 and 3,725,070 are preferably used.

When the dye providing substance represented by formula (LI) described above is incorporated into the heat-developable light-sensitive material used in the present invention, since the dye providing substance is colored, it is not so necessary to further incorporate an anti-irradiation or antihalation substance or various dyes in the light-sensitive material. However, in order to increase sharpness of images, a filter dye or an absorbing substance, etc., as described in Japanese Patent Publication No. 3692/73, U.S. Pat. Nos. 3,253,921, 2,527,583 and 2,956,879, etc., can be incorporated into the light-sensitive material used in the present invention. It is preferred for such a dye to lose its color upon heating. For example, dyes as described in U.S. Pat. Nos. 3,769,019, 3,745,009 and 3,615,432, etc., are preferably employed.

The light-sensitive material which can be used in the present invention may contain, if desired, various additives which are known to use in heat-developable light-sensitive materials, and layer other than the light-sensitive layer, for example, a protective layer, an intermediate layer, an antihalation layer, a stripping layer, etc. Various additives which can be used include those as described in *Research Disclosure,* Vol. 170, RD No. 17029 (June, 1978), for example, a plasticizer, a sharpness-improving dye, an antihalation dye, a sensitizing dye, a matting agent, a surface active agent, a fluorescent whitening agent, a color fading prevent agent, etc.

The photographic element according to the present invention is composed of a light-sensitive element which forms or releases a dye upon development by heating, and, if desired, a dye fixing element for fixing a dye. Particularly in a system wherein images are formed by diffusion transfer of dyes, both the light-sensitive element and the dye fixing element are essential. Typical photographic elements employed in such a system are divided broadly into two embodiments, that is, an embodiment in which the light-sensitive element and the dye fixing element are provided on two supports separately, and an embodiment in which the both elements are provided on the same support.

The embodiment in which the light-sensitive element and the dye fixing element are formed on different supports is further classified into two types. Specifically, one is a peel-apart type, and the other is a non-peel-apart type.

In the case of the peel-apart type, a coated surface of the light-sensitive element and a coated surface of the dye fixing element are superposed on each other after imagewise exposure or heat development, and then after formation of transferred images the light-sensitive element is rapidly peeled apart from the dye fixing element. A support of the dye fixing element is selected from an opaque support and a transparent support depending on the fact that whether the final image is a reflective type or a transmitting type. Further, a white reflective layer may be provided on the support, if desired.

In case of the latter non-peel-apart type, it is necessary that a white reflective layer is present between a light-sensitive layer of the light-sensitive element and a dye fixing layer of the dye fixing element. The white reflective layer can be provided in either the light-sensitive element or the dye fixing element. In this case, a support of the dye fixing element is required to be a transparent support.

One representative example of the embodiment in which the light-sensitive element and the dye fixing element are provided on the same support is a type in which the light-sensitive element is not necessary to peel apart from the image receiving element after the formation of transferred images. In such a case, on a transparent or opaque support a light-sensitive layer, a dye fixing layer and a white reflective layer are superposed. Examples of preferred embodiments of layer structure include transparent or opaque support/light-sensitive layer/white reflective layer/dye fixing layer, or transparent support/dye fixing layer/white reflective layer/light-sensitive layer, etc.

Another typical example of the embodiment in which the light-sensitive element and the dye fixing element are provided on the same support is a type in which a part or all of the light-sensitive element is separated from the dye fixing element and a stripping layer is provided on an appropriate position of the element as described, for example, in Japanese Patent Application (OPI) No. 67840/81, Canadian Pat. 674,082, U.S. Pat. No. 3,730,718, etc.

The light-sensitive element or the dye fixing element may form a structure having an electrically conductive heat generating layer suitable for use as heating means for the purpose of heat development or diffusion transfer of dyes.

In order to reproduce a large range of color in a chromaticity diagram using three elementary colors, i.e., yellow, magenta, and cyan, it is necessary that the light-sensitive element used in the present invention contains at least three silver halide emulsion layers each having its sensitivity in a spectral region different from each other.

Typical examples of the combination of at least three silver halide emulsion layers each having its sensitivity in a sectral region different from each other include (1) a combination of a blue-sensitive emulsion layer, a green-sensitive emulsion layer, and a red-sensitive emulsion layer, (2) a combination of a green-sensitive emulsion layer, a red-sensitive emulsion layer, and an infrared light-sensitive emulsion layer, (3) a combination of a blue-sensitive emulsion layer, a green-sensitive emulsion layer, and an infrared light-sensitive emulsion layer, (4) a combination of a blue-sensitive emulsion layer, a red-sensitive emulsion layer and an infrared light-sensitive emulsion layer, etc. The reference to an infrared light-sensitive emulsion layer as used herein means an emulsion layer having a sensitivity maximum in a region of 700 nm or more particularly in a region of 740 nm or more.

The light-sensitive material used in the present invention may also have two or more light-sensitive emulsion layers which are sensitive to light of the same spectral region but have different sensitivities, if desired.

It is necessary for the production of natural color images that each of the above described emulsion layers and/or light-insensitive hydrophilic colloid layers adjacent to the emulsion layers contains at least one kind of a dye providing substance capable of releasing or forming a yellow hydrophilic dye, a dye providing substance capable of releasing or forming a magenta hydrophilic dye, and a dye providing substance capable of releasing or forming a cyan hydrophilic dye, respectively. In other words, in each of the emulsion layers and/or light-sensitive hydrophilic colloid layers adjacent to the emulsion layers, dye providing substances capable of releasing or forming hydrophilic dyes having different hues from each other should be incorporated, respectively. If desired, two or more kinds of dye providing substances having the same hue may be used in mixture. In case of using dye providing substances which are colored originally, it is particularly advantageous that the dye providing substances are incorporated into layers other than the emulsion layer.

The light-sensitive material used in the present invention may contain, if desired, a subsidiary layer, for example, a protective layer, an intermediate layer, an antistatic layer, an anti-curling layer, a stripping layer, a matting layer, etc. in addition to the above described layers.

Particularly, the protective layer (PC) usually contains an organic or inorganic matting agent for the purpose of preventing adhesion. Further, the protective layer may contain a mordant, an ultraviolet light absorbing agent, etc. The protective layer and the intermediate layer may be composed of two or more layers, respectively.

Moreover, the intermediate layer may contain a reducing agent for preventing color mixing, an ultraviolet light absorbing agent, a white pigment such as $TiO_2$, etc. The white pigment may be incorporated into the emulsion layer in addition to the intermediate layer, for the purpose of increasing the sensitivity.

In order to impart the spectral sensitivity as described above to the silver halide emulsion, the silver halide emulsion may be spectrally sensitized using known sensitizing dyes so as to obtain the desired spectral sensitivity.

The dye fixing element which can be used in the present invention comprises at least one layer containing a mordant. When the dye fixing layer is positioned on the surface of the dye fixing element, a protective layer can be further provided in the element, if desired.

A water absorbing layer or a layer containing a dye transfer assistant may be provided in order to sufficiently incorporate the dye transfer aasistant, if desired, or in order to control the dye transfer assitant. These layers may be provided adjacent to the dye fixing layer or provided through an intermediate layer.

The dye fixing layer used in the present invention may be composed of two or more layers containing mordants which have mordanting powers different from each other, if desired.

The dye fixing element used in the present invention may contain, if desired, a subsidiary layer, for example, a stripping layer, a matting layer, an anti-curling layer, etc., in addition to the above described layers.

Into one or more of the layers described above, a base and/or base precursor for the purpose of accelerating dye transfer, a hydrophilic thermal solvent, a color fading preventing agent for preventing fading of dyes, an ultraviolet light absorbing agent, a dispersed vinyl compound for the purpose of increasing dimensional stability, a fluorescent whitening agent, etc. may be incorporated.

The binder which can be used in the above described layers is preferably a hydrophilic binder. The typical hydrophilic binder is a transparent or translucent hydrophilic colloid, examples of which include a natural substance, for example, a protein such as gelatin, a gelatin derivative, polyvinyl alcohol, a cellulose derivative, etc., a polyaccharide such as starch, gum arabic, etc., and a synthetic polymer compound, for example, dextrin, pullulan, a water-soluble polyvinyl compound such a polyvinyl alcohol, polyvinyl pyrrolidone, acrylamide polymer, etc. Among them, gelatin and polyvinyl alcohol are particularly preferred.

The dye fixing element may have a reflective layer containing a white pigment such as titanium oxide, etc., a neutralizing layer, a neutralization timing layer, etc., in addition to the above described layer depending on the purposes. These layers may be provided not only in the dye fixing element, but also in the light-sensitive element. The compositions of these reflective layer, neutralizing layer, and neutralization timing layer are decribed, for example, in U.S. Pat. Nos. 2,983,606, 3,362,819, 3,362,821 and 3,415,644, Canadian Pat. No. 928,559, etc.

It is advantageous that the dye fixing element according to the present invention contains a transfer assistant as described below. The transfer assistant may be incorporated into the above described dye fixing layer or another layer.

The dye fixing layer employed in the present invention includes a dye fixing layer which can be used in heat-developable color light-sensitive materials. A mordant to be used can be selected appropriately from mordants conventionally used. Among them, polymeric mordants are particularly preferred. The polymeric mordants include polymers containing tertiary amino groups, polymers containing nitrogen-containing heterocyclic moieties, and polymers containing quaternary cationic groups thereof, etc.

Specific examples of polymers containing vinyl monomer units having a tertiary amino group are described in Japanese Patent Application (OPI) Nos. 60643/85 and 57836/85, etc. Specific examples of polymers containing vinyl monomer units having a tertiary imidazole group are described in Japanese Patent Application (OPI) Nos. 118834/85 and 122941/85, U.S. Pat. Nos. 4,282,305, 4,115,124 and 3,148,061, etc.

Specific examples of preferred polymers containing vinyl monomer units having quaternary imidazolium salt are described in British Pat. Nos. 2,056,101, 2,093,041 and 1,594,961, U.S. Pat. Nos. 4,124,386, 4,115,124, 4,273,853 and 4,450,224, Japanese Patent Application (OPI) No. 28225/73, etc.

Specific examples of other preferred polymers containing vinyl monomer units having a quaternary ammonium salt are described in U.S. Pat. Nos. 3,709,690, 3,898,088, and 3,958,995, Japanese Patent Application (OPI) Nos. 57836/85, 60643/85, 122940/85, 122942/85 and 235134/85, etc.

In the present invention, a transparent or opaque heat generating element used in the case of adopting current heating as a means for development can be prepared utilizing heretofore known techniques with respect to a resistance heat generator.

The resistance heat generator includes a method utilizing a thin layer of an inorganic material exhibiting semiconductor properties, and a method utilizing a thin layer of an organic material composed of electrically conductive fine particles dispersed in a binder. The materials which can be employed in the former method include silicon carbide, molybdenum silicide, lanthanum chromate, barium titanate ceramics used as a PTC thermistor, tin oxide, zinc oxide, etc. These materials can be used to prepare a transparent or opaque thin layer in a known manner. With the latter method, electrically conductive fine particles such as metallic fine particles, carbon black, graphite, etc., are dispersed in a binder such a rubber, a synthetic polymer, gelatin, etc., to prepare a resistor having a desired temperature characteristic. The resistor may be either directly brought into contact with the light-sensitive element or separated by a support or an intermediate layer, etc.

The relationship of positions of the heat generating element and the light-sensitive element are illustrated below.

Heat generating element/support/light-sensitive element

Support/heat generating element/light-sensitive element

Support/heat generating element/intermediate layer/light-sensitive element

Support/light-sensitive element/heat generating element

Support/light-sensitive element/intermediate layer/-heat generating element

A protective layer, an intermediate layer, a subbing layer, a back layer and other layers can be produced by preparing each coating solution and applying it to a support by various coating methods such as a dip coating method, an air-knife coating method, a curtain coating method or a hopper coating method as described in U.S. Pat. No. 2,681,294 and drying in the same manner as used in preparing the light-sensitive layer or the dye fixing layer according to the present invention, by which the light-sensitive material is obtained.

If desired, two or more layers may be applied at the same time by the method as described in U.S. Pat. No. 2,761,791 and British Pat. No. 837,095.

As light sources of imagewise exposure in order to record images on the heat-developable light-sensitive material, radiant rays including visible light can be utilized. Generally, light sources used for conventional color prints can be used, example of which include tungsten lamps, mercury lamps, halogen lamps such as iodine lamps, xenon lamps, laser light sources, CRT light sources, fluorescent tubes, and light emitting diodes (LED), etc.

In accordance with the method for forming images according to the present invention, images having a high density are obtained in a short period of time using a more reduced amount of a base by heating the light-sensitive material simultaneously with or after imagewise exposure in the presence of water, a reducing agent and at least one kind of intensifying agents. Further, even when a more reduced amount of silver is used, images having a high density are obtained.

Therefore, it is understood that a large amplifying effect is obtained using a base in a relatively small amount by means of the method according to the present invention. Moreover, it is apparent that a large catalytic reaction occurs in the light-sensitive material containing compounds which release a strong catalyst poison by heat development such as silver iodobromide, silver bromide, silver benzotriazole, etc.

The present invention is explained in greater detail with reference to the following examples, but the present invention should not be construed as being limited thereto.

EXAMPLE 1

A method for preparing a silver benzotriazole emulion is described below.

28 g of gelatin and 13.2 g of benzotriazole were dissolved in 300 ml of water and the solution was maintained at 40° C. with stirring. A solution of 17 g of silver nitrate dissolved in 100 ml of water was added to the above prepared solution over 2 minutes. The thus prepared silver benzotriazole emulsion was adjusted in pH, precipitated and freed of excess salts. It was then adjusted to a pH of 6.30, whereby 400 g of a silver benzotriazole emulsion was obtained.

A method for preparing silver halide emulsions for the fifth layer and the first layer is described in the following.

To an aqueous solution of gelatin (prepared by dissolving 20 g of gelatin and 3 g of sodium chloride in 1,000 ml of water maintained at 75° C.) were added simultaneously 600 ml of an aqueous solution containing sodium chloride and potassium bromide and an aqueous solution of silver nitrate (prepared by dissolving 0.59 mole of silver nitrate in 600 ml of water) over 40 minutes at an equal addtion amount rate while stirring thoroughly. Thus, a monodispersed silver chlorobromide emulsion (bromide content: 50 mol%, crystal form: cubic, average grain size: 0.40 μm) was prepared.

After washing with water and desalting, 5 mg of sodium thiosulfate and 20 mg of 4-hydroxy-6-methyl-1,3,3a,7-tetraazaindene were added and then it was subjected to chemical sensitization at 60° C. The yield of the emulsion was 600 g.

A method for preparing a silver halide emulsion for the third layer is described in the following.

To an aqueous solution of gelatin (prepared by dissolving 20 g of gelatin and 3 g of sodium chloride in 1,000 ml of water maintained at 75° C.) were added simultaneously 600 ml of an aqueous solution containing sodium chloride and potassium bromide and an aqueous solution of silver nitrate (prepared by dissolving 0.59 mole of silver) nitrate in 600 ml of water) over 40 minutes at an equal addition amount rate while stirring thoroughly. Thus, a monodispersed silver chlorobromide emulsion (bromide content: 80% mol%, crystal form: cubic, average grain size: 0.35 μm) was prepared.

After washing with water and desalting, 5 mg of sodium thiosulfuate and 20 mg of 4-hydroxy-6-methyl-1,3,3a,7-tetraazaindene were added and then it was subjected to chemical sensitization at 60° C. The yield of the emulsion was 600 g.

A method for preparing a gelatin dispersion of dye providing substance is described in the following.

A mixture of 5 g of Yellow Dye Providing Substance (A) described below, 0.5 g of succinic acid 2-ethylhexyl ester sulfonic acid sodium salt, as a surface active agent, 10 g of triisononyl phosphate and 30 ml of ethyl acetate was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes. The dispersion thus obtained was designated a dispersion of yellow dye providing substance.

A dispersion of magenta dye providing substance was prepared in the same manner as described above except using Magenta Dye Providing Substance (B) described below and using 7.5 g of tricresyl phosphate as an organic solvent having a high boiling point. Further, a dispersion of cyan dye providing substance was prepared in the same manner for the dispersion of yellow dye providing substance as described above, except using Cyan Dye Providing Substance (C) described below.

A color light-sensitive material having a multilayer structure as shown in the table below was prepared. In the following table, the coating amount of each component is set forth in mg/m² in parentheses.

Sixth Layer: Gelatin (800 mg/m²), Hardening agent*3 (16 mg/m²), Silica*5 (100 mg/m²)

Fifth Layer (Green-sensitive emulsion layer): Silver chlorobromide emulsion (bromide: 50 mol%, silver: 400 mg/m²), Benzenesulfonamide (180 mg/m²), Silver benzotriazole emulsion (silver: 100 mg/m²), Sensitizing dye D-1 ($1\times10^{-6}$ mol/m²), Hardening agent*3 (16 mg/m²), Yellow dye providing substance (A) (400 mg/m²), Gelatin (1,000 mg/m²), Solvent having a high boiling point*4 (800 mg/m²), Surface active agent*2 (100 mg/m²)

Fourth Layer (Intermediate layer): Gelatin (900 mg/m²), Hardening agent*3 (18 mg/m²)

Third Layer (Red-sensitive emulsion layer): Silver chlorobromide emulsion (bromide: 80 mol%, silver: 300 mg/m²), Benzenesulfonamide (180 mg/m²), Silver benzotriazole emulsion (silver: 100 mg/m²), Sensitizing dye D-2 ($8\times10^{-7}$ mol/m²), Hardening agent*3 (18 mg/m²), Magenta dye providing substance (B) (400 mg/m²), Gelatin (1,000 mg/m²), Solvent having a high boiling point*1 (600 mg/m²), Surface active agent*2 (100 mg/m²)

Second Layer (Intermediate layer): Gelatin (800 mg/m²), Hardening agent*3 (16 mg/m²)

First Layer (Infrared-sensitive emulsion layer): Silver chlorobromide emulsion (bromide: 50 mol%, silver: 300 mg/m²), Benzenesulfonamide (180 mg/m²), Silver benzotriazole emulsion (silver: 100 mg/m²), Sensitizing dye D-3 ($1\times10^{-8}$ mol/m²), Hardening agent*3 (16 mg/m²), Cyan dye providing substance (C) (300 mg/m²), Gelatin (1,000 mg/m²), Solvent having a high boiling point*4 (600 mg/m²), Surface active agent*2 (100 mg/m²)

| Support |
|---|
| *1 Tricresyl phosphate |
| *2 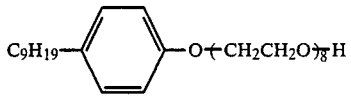 |
| *3 2,4-Dichloro-6-hydroxy-1,3,5-triazine |
| *4 (iso-$C_9H_{19}O)_3P{=}O$ |
| *5 Size: 4 μm |

Yellow Dye Providing Substance (A)

-continued

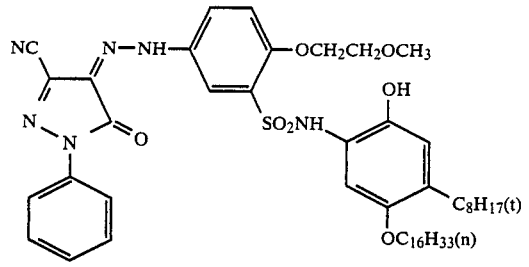

Magenta Dye Providing Substance (B)

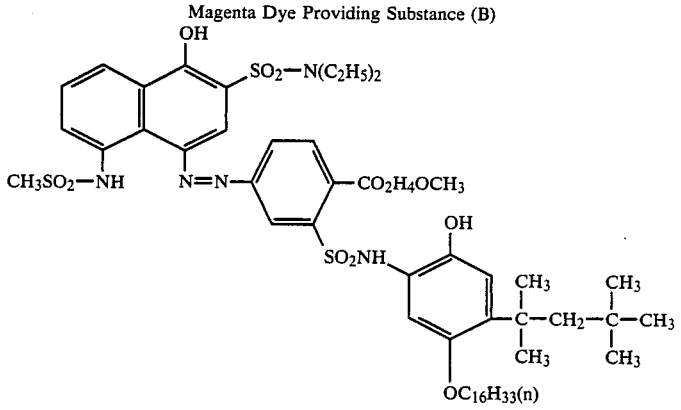

Cyan Dye Providing Substance (C)

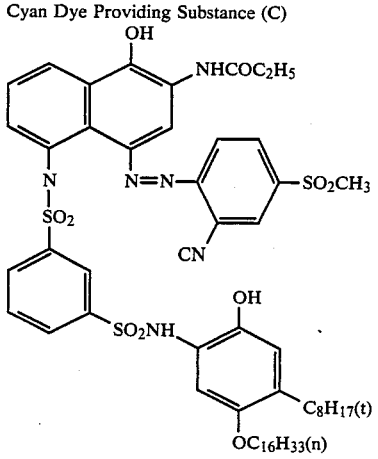

Sensitizing Dye D-1

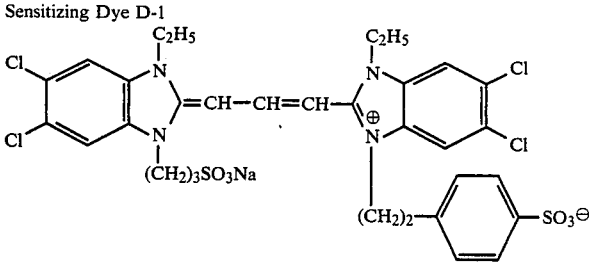

Sensitizing D-2

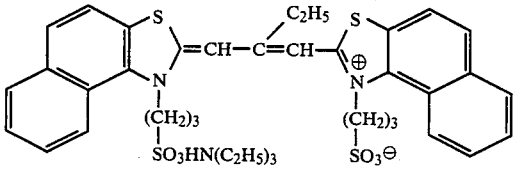

Sensitizing Dye D-3

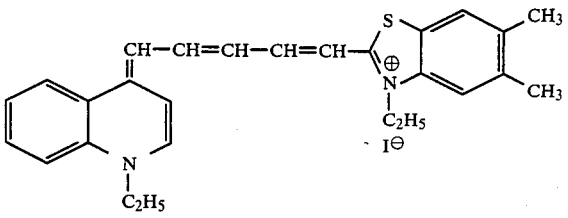

A method for preparing a dye fixing material is described below.

10 g of poly(methyl acrylate-co-N,N,N-trimethyl-N-vinylbenzylammonium chloride) (molar ratio of methyl acrylate to vinylbenzylammonium chloride was 1/1) was dissolved in 175 ml of water and then uniformly mixed with 100 g of a 10% aqueous solution of lime-processed gelatin. To the mixture was added 25 ml of a 4% aqueous solution of 2,4-dichloro-6-hydroxy-1,3,5-triazine and the resulting mixture was uniformly coated at a wet layer thickness of 90 μm on a paper support laminated with polyethylene containing titanium dioxide dispersed therein.

On the thus formed layer was further coated the solution containing the base as shown in Table 1 below, 18 ml of water, 20 g of a 10% aqueous solution of gelatin and 4.8 ml of a 1% aqueous solution of succinic acid 2-ethylhexyl ester sulfonic acid sodium salt at a wet layer thickness of 30 μm and dried. Thus, Dry Fixing Materials D-1 to D-4 each having a mordant layer were prepared.

The above described multilayer color light-sensitive material was exposed through a three color separation filter of G, R and IR (G: filter transmitting a band of 500 nm to 600 nm, R: filter transmitting a band of 600 nm to 700 nm, IR: filter transmitting a band of 700 nm or more), the density of which continuously changed, for 1 second at 500 lux using a tungsten lamp.

To the coated layer of the dye fixing material was applied 20 ml/m$^2$ of water or a 1% aqueous solution of hydrogen peroxide using a wire bar, and the exposed light-sensitive material described above was then superimposed on the dye fixing material in such a manner that their coated layers were in contact with each other.

After heating for 20 seconds using a heat roller which was adjusted so as to render the temperature of the water-absorbed layer at 90° C. to 95° C., the dye fixing material was separated from the light-sensitive material, whereupon clear yellow, magenta and cyan color images were obtained in the dye fixing material corresponding to the three color separation filter of G (green), R (red), and IR (infrared) respectively.

The maximum density and the minimum density of each color were measured using a Macbeth reflection densitometer (RD-519).

The results thus obtained are shown in Table 1.

TABLE 1

| Dye Fixing Material | Base (Amount Added) | Hydrogen Peroxide | Maximum Density | | | Minimum Density | | |
|---|---|---|---|---|---|---|---|---|
| | | | Yellow | Magneta | Cyan | Yellow | Magenta | Cyan |
| D-1 | Guanidine carbonate (6.0 g) | not present | 2.11 | 1.92 | 1.76 | 0.14 | 0.17 | 0.18 |
| D-2 | Guanidine carbonate (1.5 g) | present | 2.09 | 1.90 | 1.77 | 0.14 | 0.15 | 0.17 |
| D-2 | Guanidine carbonate (1.5 g) | not present | 1.20 | 1.07 | 1.05 | 0.12 | 0.12 | 0.13 |
| D-3 | Sodium carbonate (6.0 g) | not present | 1.82 | 1.58 | 1.66 | 0.13 | 0.15 | 0.13 |
| D-4 | Sodium carbonate (1.5 g) | present | 1.89 | 1.66 | 1.68 | 0.13 | 0.15 | 0.14 |
| D-4 | Sodium carbonate (1.5 g) | not present | 1.00 | 0.98 | 0.96 | 0.11 | 0.12 | 0.12 |

From the results shown in Table 1, it is clear that by means of the method using the intensifying agent according to the present invention, sufficiently high densities are obtained even when the amount of the base is greatly reduced.

EXAMPLE 2

In the same manner as described in Example 1 except using an acetylene silver emulsion prepared by a method shown below in place of the silver benzotriazole emulsion used in Example 1, Light-Sensitive Materials A and B were prepared.

Method for preparation of acetylene silver emulsion

A solution containing 17.7 g of 4-acetylaminophenylacetylene dissolved in 100 ml of methanol and a solution containing 28 g of gelatin dissolved in 200 ml of water were mixed and the solution was maintained at 40° C. with stirring. A solution of 17 g of silver nitrate dissolved in 100 ml of water was added to the above prepared solution over 2 minutes. The thus prepared emulsion was adjusted in pH, precipitated and freed of excess salts. It was then adjusted to pH 6.3, whereby 400 g of a 4-acetylaminophenylacetylene silver emulsion was obtained.

Light-Sensitive Materials A and B were prepared using the coating amount of silver as shown below.

To each of the emulsion layers 8 mg/m$^2$ of benzotriazole was added.

| | | Light-Sensitive Material A | Light-Sensitive Material B |
|---|---|---|---|
| First Layer | Silver Chlorobromide emulsion | 300 mg/m$^2$ | 100 mg/m$^2$ |
| | Acetylene silver emulsion | 100 mg/m$^2$ | 50 mg/m$^2$ |
| Third Layer | Silver chlorobromide emulsion | 300 mg/m$^2$ | 100 mg/m$^2$ |
| | Acetylene silver emulsion | 100 mg/m$^2$ | 50 mg/m$^2$ |
| Fifth Layer | Silver chlorobromide emulsion | 400 mg/m$^2$ | 100 mg/m$^2$ |
| | Acetylene silver emulsion | 100 mg/m$^2$ | 60 mg/m$^2$ |

Using Light-Sensitive Materials A and B and Dye Fixing Material D-4 as described in Example 1, the same procedure as described in Example 1 was conducted. The results thus obtained are shown in Table 2.

TABLE 2

| Light-Sensitive Material | Hydrogen Peroxide | Maximum Density | | | Minimum Density | | |
|---|---|---|---|---|---|---|---|
| | | Yellow | Magenta | Cyan | Yellow | Magenta | Cyan |
| A | not present | 1.80 | 1.62 | 1.69 | 0.14 | 0.16 | 0.16 |
| A | present | 2.01 | 2.00 | 2.10 | 0.14 | 0.15 | 0.15 |
| B | not present | 1.05 | 0.95 | 0.91 | 0.11 | 0.11 | 0.12 |
| B | present | 1.82 | 1.70 | 1.66 | 0.12 | 0.12 | 0.13 |

From the results shown in Table 2, it is clear that by means of the method using the intensifying agent according to the present invention, sufficiently high densities are obtained even when the coating amount of silver is greatly reduced.

EXAMPLE 3

Light-Sensitive Material B as described in Example 2 and Dye Fixing Material D-4 as described in Example 1 were employed. Light-Sensitive Material B was exposed in the same manner as described in Example 1, on the emulsion side of which was applied 20 ml/m$^2$ of water or the aqueous solution as shown in Table 3 below using a wire bar, and the light-sensitive material was then superimposed on Dye Fixing Material D-4 in such a manner that their coated layers were in contact with each other, followed by the same procedure as described in Example 1. The results thus obtained are shown in Table 3.

TABLE 3

| Composition of Aqueous Solution | Maximum Density | | | Minimum Density | | |
|---|---|---|---|---|---|---|
| | Yellow | Magenta | Cyan | Yellow | Magenta | Cyan |
| Water (Comparison) | 1.05 | 0.95 | 0.91 | 0.11 | 0.11 | 0.12 |
| $[Co(NH_3)_6]Cl_3$: 8 g/l (Present Invention) | 1.50 | 1.62 | 1.57 | 0.14 | 0.13 | 0.14 |
| Sodium Chlorite: 8 g/l (Present Invention) | 1.63 | 1.58 | 1.60 | 0.13 | 0.13 | 0.14 |
| Sodium o-Iodosobenzoate: 6 g/l (Present Invention) | 1.61 | 1.68 | 1.62 | 0.13 | 0.14 | 0.14 |

From the results shown in Table 3, it is clear that by means of the method using the intensifying agent according to the present invention, sufficiently high densities are obtained even when the coating amount of silver is greatly reduced.

EXAMPLE 4

A method for preparing a dye fixing material is described below.

10 g of poly(methyl acrylate-co-N,N,N-trimethyl-N-vinylbenzylammonium chloride) (molar ratio of methyl acrylate to vinylbenzylammonium chloride was 1/1) was dissolved in 175 ml of water and then uniformly mixed with 100 g of a 10% aqueous solution of lime-processed gelatin. To the mixture was added 25 ml of a 4% aqueous solution of 2,4-dichloro-6-hydroxy-1,3,5-triazine and the resulting mixture was uniformly coated at a wet layer thickness of 90 μm on a paper support laminated with polyethylene containing titanium dioxide dispersed therein and dried. The thus prepared material was used as Dye Fixing Material D-5 having a mordant layer.

Dye Fixing Material D-5 described above was supplied with 20 ml/m$^2$ of each of the aqueous solutions as shown in Table 4 below using a wire bar and then superimposed on Light-Sensitive Material B as described in Example 2 which had been exposed in such a manner that their coated layers were in contact with each other. Thereafter, the same procedures as described in Example 1 were conducted. The results thus obtained are shown in Table 4.

TABLE 4

| Aqueous Solution Supplied to Dye Fixing Material D-5 | Maximum Density | | | Minimum Density | | |
|---|---|---|---|---|---|---|
| | Yellow | Magenta | Cyan | Yellow | Magenta | Cyan |
| I (Comparison) | 0.99 | 0.92 | 0.89 | 0.11 | 0.11 | 0.12 |
| II (Present Invention) | 1.65 | 1.69 | 0.62 | 0.12 | 0.12 | 0.14 |
| III (Present Invention) | 1.59 | 1.60 | 1.55 | 0.12 | 0.11 | 0.14 |
| IV (Present Invention) | 1.80 | 1.73 | 1.70 | 0.13 | 0.12 | 0.14 |
| V (Present Invention) | 1.42 | 1.57 | 1.59 | 0.14 | 0.12 | 0.15 |
| VI (Present Invention) | 1.50 | 1.58 | 1.53 | 0.13 | 0.12 | 0.14 |
| VII (Present Invention) | 1.54 | 1.60 | 1.55 | 0.14 | 0.13 | 0.14 |

Compositions of Aqueous Solutions:
I: 0.8 M $K_2CO_3$ + 0.1% EDTA-4Na
II: 0.8 M $K_2CO_3$ + 1% $H_2O_2$ + 0.1% EDTA-4Na
III: 0.8 M $NaBO_2$ + 0.8 M $NaBO_3$ + 0.1% EDTA-4Na
IV: 0.8 $MK_3PO_4$ + 1% $H_2O_2$ + 0.1% EDTA-4Na
V: 0.8 M $K_2CO_3$ + $[Co(NH_3)_6]Cl_3$ : 2.0 g
VI: 0.8 M $K_2CO_3$ + 3.5% $NaClO_2$
VII: 0.8 M $K_2CO_3$ + 3.5% Sodium o-Indosobenzoate From the results shown in Table 4, it is understood that the effect of the present invention is equally obtainable by supplying externally the base together with the intensifying agent according to the present invention as compared with the case wherein the base is incorporated into the dye fixing material.

EXAMPLE 5

Method for preparation of silver benzotriazole emulsion containing light-sensitive silver bromide 6.5 g of benzotriazole and 10 g of gelatin were dissolved in 1,000 ml of water and the solution was maintained at 50° C. with stirring. A solution of 8.5 g of silver nitrate dissolved in 100 ml of water was added to the above-prepared solution over a 2 minute period. Then, a solution of 1.2 g of potassium bromide dissolved in 50 ml of water was added over a 2 minute period. The thus-prepared emulsion was adjusted in pH, precipitated, and freed of excess salts. It was then adjusted to a pH of 6.0, whereby 200 g of a silver benzotriazole emulsion containing silver bromide was obtained.

Method for preparation of a gelatin dispersion of a dye providing substance

A mixture of 10 g of a dye providing substance having the structure shown below, 0.5 g of succinic acid 2-ethylhexyl ester sulfonic acid sodium salt, as a surface active agent, 4 g of tricresyl phosphate (TCP) and 20 ml of cyclohexanone was dissolved by heating at about 60° C. to prepare a uniform solution. This solution was mixed with 100 g of a 10% aqueous solution of lime-processed gelatin with stirring and the mixture was dispersed by means of a homegenizer at 10,000 rpm for 10 minutes.

Dye Providing Substance

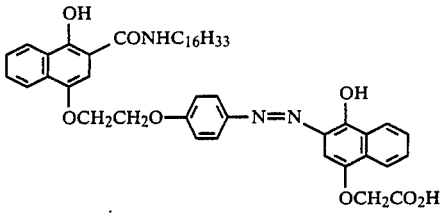

A method for preparing a light-sensitive coating composition is described below.

(a) silver benzotriazole emulsion containing light-sensitive silver bromide: 10 g
(b) Dispersion of dye providing substance: 3.5 g
(c) Gelatin (10% aqueous solution): 5 g
(d) Solution of 0.2 g of 2,6-dichloro-4-aminophenol dissolved in 2 ml of methanol:
(e) 10% Aqueous solution of a compound having the following formula: 1 ml

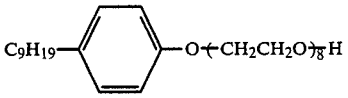

The above components (a) to (e) were mixed and dissolved by heating and the solution was coated on a polyethylene terephthalate film having a thickness of 180 μm to have a wet layer thickness of 30 μm.

On the thus formed layer was further coated the solution having the components (a) to (c) described below at a wet layer thickness of 30 μm as a protective layer and dried to prepare Light-Sensitive Material C.

(a) 10% Aqueous solution of gelatin: 30 ml
(b) Water: 60 ml
(c) 2% Aqueous solution of 2,4-dichloro-6-hydroxy-1,3,5-triazine: 5 ml Light-Sensitive Material C thus prepared was exposed imagewise at 2,000 lux for 10 seconds using a tungsten lamp. Thereafter, the same procedure as described in Example 1 was conducted using Dye Fixing Material D-2 as described in Example 1. The results thus obtained are shown in Table 5.

TABLE 5

| Hydrogen Peroxide | Maximum Density | Minimum Density |
|---|---|---|
| not present | 1.24 | 0.13 |
| present | 1.88 | 0.15 |

From the results shown in Table 5, it is clear that a sufficiently high density is obtained by means of the method using the intensifying agent according to the present invention.

EXAMPLE 6

A method for preparing a dye fixing material is described below.

10 g of poly(methyl acrylate-co-N,N,N-trimethyl-N-vinylbenzylammonium chloride) (molar ratio of methyl acrylate to vinylbenzylammonium chloride was 1/1) was dissolved in 175 ml of water and then uniformly mixed with 100 g of a 10% aqueous solution of lime-processed gelatin. To the mixture was added 25 ml of a 4% aqueous solution of 2,4-dichloro-6-hydroxy-1,3,5-triazine and the resulting mixture was uniformly coated at a wet layer thickness of 90 μm on a paper support laminated with polyethylene containing titanium dioxide dispersed therein.

On the thus formed layer was further coated the solution containing the intensifying agent is shown in Table 6 below, 18 ml of water, 20 g of a 10% aqueous solution of gelatin and 4.8 ml of a 1% aqueous solution of succinic acid 2-ethylhexyl ester sulfonic acid sodium salt at a wet layer thickness of 30 μm and dried. The thus prepared materials were used as Dye Fixing Materials D-6 to D-9.

For comparison, Dye Fixing Material D-10 was prepared without using the intensifying agent.

Dye Fixing Materials D-6 to D-10 described above was supplied with 20 ml/m$^2$ of a 6% aqueous solution of quanidine carbonate using a wire bar and then superimposed on Light-Sensitive Material C as described in Example 5 which had been exposed in such manner that their coated layers were in contact with each other. Thereafter, the same procedures as described in Example 1 were conducted. The results thus obtained are shown in Table 6.

TABLE 6

| Dye-Fixing Material | Intensifying Acent | Maximum Density | Minimum Density |
|---|---|---|---|
| D-6 (Present Invention) | $NaBO_3$ (1.0 g) | 1.76 | 0.14 |
| D-7 (Present Invention) | $[Co(NH_3)_6]Cl_3$ (0.8 g) | 1.62 | 0.16 |
| D-8 (Present Invention) | $NaClO_2$ (1.0 g) | 1.63 | 0.14 |
| D-9 (Present Invention) | Sodium o-Indoso-benzoate (0.8 g) | 1.78 | 0.15 |
| D-10 (Comparison) | None | 1.12 | 0.12 |

From the results shown in Table 6, it is understood that the effect of the present invention is sufficiently obtained in case of incorporating the intensifying agent into the dye fixing material.

EXAMPLE 7

Method for preparation of a gelatin dispersion of a dye providing substance

A mixture of 5 g of a dye providing substance which is capable of being reduced having the structure shown below, 4 g of an electron donative substance having the structure shown below, 0.5 g of succinic acid 2-ethylhexyl ester sulfonic acid sodium salt, 10 g of tricresyl phosphate (TCP) and 20 ml of cyclohexanone was dissolved by heating at about 60° C. to prepare a solution. This solution was mixed with 100 g of a 10% aqueous solution of gelatin with stirring and the mixture was dispersed by means of a homogenizer at 10,000 rpm for 10 minutes.

Dye Providing Substance

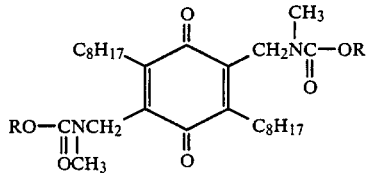

-continued

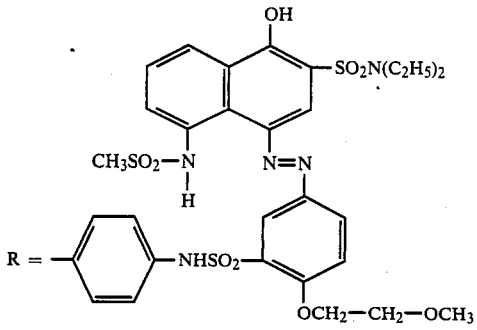

Electron Donative Substance

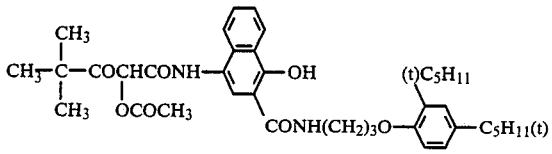

A method for preparing a light-sensitive coating composition is described in the following.

(a) Silver benzotriazole emulsion containing light-sensitive silver bromide (same as described in Example 5): 10 g (b) Dispersion of dye providing substance: 3.5 g (c) 5% Aqueous solution of a compound having the following formula: 1.5 ml

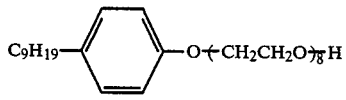

The above components (a) to (c) were mixed and dissolved by heating and the mixture was coated on a polyethylene terephthalate film at a wet layer thickness of 30 μm and dried.

On the thus formed layer was further coated the solution containing components (a) to (c) as described below at a wet layer thickness of 30 μm as a protective layer and dried to prepare Light-Sensitive Material.

(a) 10% Aqueous solution of gelatin: 30 g (b) 2% Aqueous solution of 2,4-dichloro-6-hydroxy-1,3,5-triazine: 5 ml (c) Water: 65 ml The light-sensitive material thus prepared was exposed imagewise at 2,000 lux for 10 seconds using a tungsten lamp. Thereafter, the same procedures as described in Example 1 were conducted using Dye Fixing Material D-2 as described in Example 1. The results thus obtained are shown in Table 7.

TABLE 7

| Hydrogen Peroxide | Maximum Density | Minimum Density |
|---|---|---|
| not present | 1.20 | 0.28 |
| present | 1.83 | 0.21 |

From the results shown in Table 7, it is understood that a sufficiently high density is obtained by means of the method using the intensifying agent according to the present invention.

EXAMPLE 8

On a polyethylene terephthalate film support were coated the layers as shown below in the order described below to prepare a light-sensitive material.

Emulsion Layer:

A layer containing silver benzotriazole (silver: 0.62 g/m$^2$), silver iodobromide (iodide content: 10 mol%, silver: 1.42 g/m$^2$), dye developer 5A described below (0.52 g/m$^2$), gelatin (4.25 g/m$^2$), auxiliary developing agent of the formula W described below (0.11 g/m$^2$), antifogging agent of the formula X described below (0.20 g/m$^2$), surface active agent of the formula Y described below (0.40 g/m$^2$), compound of the formula Z described below (0.95 g/m$^2$), and tricresyl phosphate (0.90 g/m$^2$).

Protective Layer

A layer containing gelatin (1.2 g/m$^2$) and 2,4-dichloro-6-hydroxy-1,3,5-triazine (0.10 g/m$^2$).

Dye Developer 5A

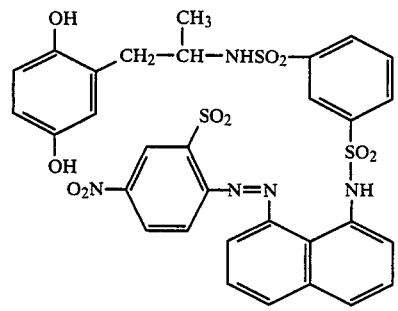

Auxiliary Developing Agent of Formula W:

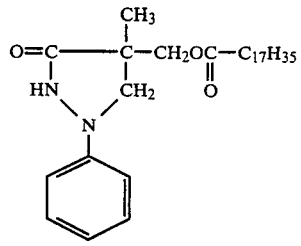

Antifogging Agent of Formula X:

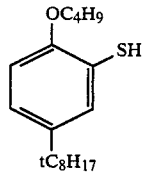

Surface Active Agent of Formula Y:

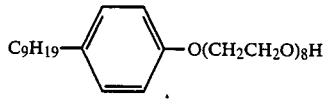

Compound of Formula Z:

-continued

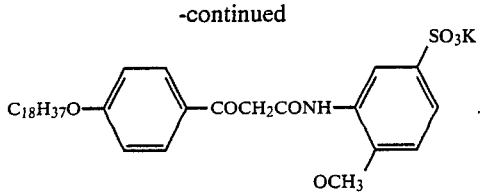

The light-sensitive material thus prepared was exposed imagewise at 2,000 lux for 10 seconds using a tungsten lamp. Thereafter, the same procedures as described in Example 1 were conducted using Dye Fixing Material D-2 as described in Example 1. The results thus obtained are shown in Table 8.

TABLE 8

| Hydrogen Peroxide | Maximum Density | Minimum Density |
|---|---|---|
| not present | 1.00 | 0.64 |
| present | 1.58 | 0.42 |

From the results shown in Table 8, it is understood that clear images are obtained by means of the method according to the present invention even when the amount of the base is reduced.

EXAMPLE 9

A method for preparing a silver halide emulsion is described in the following.

To an aqueous solution of gelatin (prepared by dissolving 20 g of gelatin and 1 g of sodium chloride in 1,000 ml of water maintained at 55° C.) were added simultaneously 600 ml of an aqueous solution cntaining sodium chloride and potassium bromide and an aqueous solution of silver nitrate (prepared by dissolving 0.59 mole of silver nitrate in 600 ml of water) over 30 minutes at an equal addition amount rate while stirring thoroughly. Thus, a monodispersed silver chlorobromide emulsion (bromide content: 20 mol%, crystal form: cubic, average grain size: 0.20 μm) was prepared.

After washing with water and desalting, 5 mg of sodium thiosulfate and 30 mg of 4-hydroxy-6-methyl-1,3,3a,7-tetraazaindene were added and then it was subjected to chemical sensitization at 60° C. The yield of the emulsion was 600 g.

The same acetylene silver emulsion as prepared in Example 2 was used as a acetylene silver emulsion.

A method for preparing a gelatin dispersion of dye providing substance is described in the following.

A mixture of 10 g of 2-[α-(2,4-di-tert-amylphenoxy)-butanamido]-4,6-dichloro-5-methylphenol, as a dye providing substance, 0.5 g of succinic acid 2-ethyl-hexyl ester sulfonic acid sodium salt, as a surface active agent, 5 g of triisononyl phosphate and 30 ml of ethyl acetate was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes. The dispersion thus obtained was designated a dispersion of dye providing substance.

On a paper support laminated with polyethylene containing titanium dioxide dispersed therein, a first layer and a second layer as shown in the following table were coated to prepare Light-Sensitve Material 901. In the following table, the coating amount of each component is set forth in mg/m$^2$ in parentheses.

Second Layer: Gelatin (1,000 mg/m$^2$), Hardening agent*1 (40 mg/m$^2$)

First Layer: Silver chlorobromide emulsion (bromide: 50 mol%, silver: 300 mg/m$^2$), Acetylene silver emulsion (50 mg/m$^2$), Dye providing substance (400 mg/m$^2$), Solvent having a high boiling point*2 (200 mg/m$^2$), Gelatin (1,000 mg/m$^2$), 2,6-Dichloro-4-aminophenol (100 mg/m$^2$) Support

*1 1,2-Bis(vinylsulfonylacetamido)ethane

*2 n-Butyl phthalate

Furthermore, Light-Sensitive Material 902 having the same composition as in Light-Sensitive Material 901 except that the amounts of the silver chlorobromide emulsion and the acetylene silver emulsion were changed to 40 mg/m$^2$ (as silver) and 10 mg/m$^2$, respectively was prepared in the same manner as above.

These light-sensitive materials were exposed imagewise at 2,000 lux for 3 seconds using a tungsten lamp. Thereafter, the emulsion side of Light-Sensitive Material 901 and the emulsion side of Light-Sensitive Material 902 were respectively applied with Aqueous Solutions A and B as shown in the following table using a wire bar, and each of the light-sensitive materials was then superimposed on a polyethylene terephthalate film in such a manner that their coated layers were in contact with each other.

After heating for 20 seconds using a heat roller which was adjusted so as to render the temperature of the water-absorbed layer at 90° C. to 95° C., the polyethylene terephthalate film was separated from the light-sensitive material, whereupon a cyan image was obtained in the light-sensitive material.

The maximum density and the minimum density as measured are shown in Table 6.

Solution A: 0.5M $K_3PO_4$+0.1% EDTA-4Na+$H_3PO_4$ to make the pH at 10.0

Solution B: 0.5M $K_3PO_4$+0.1% EDTA-4Na+1% $H_2O_2$+$H_3PO_4$ to make the pH at 10.0

TABLE 2

| Light-Sensitive Material | Maximum Density | Minimum Density |
|---|---|---|
| 901 (Comparison) | 1.98 | 0.54 |
| 902 (Invention) | 1.74 | 0.30 |

In Light-Sensitive Material 901, a number of developed silvers overlapped in the image area, and a turbid image was obtained. On the other hand, in Light-Sensitive Material 902, because of less developed silvers, the turbidity of image was slight.

Furthermore, in Light-Sensitive Material 901, the fogging due to print-out silver markedly increased during the preservation, whereas in Light-Sensitive Material 902, an increase of fog was small.

From the foregoing results, it is understood that images are obtained within a short period of time according to the method of the present invention even when the amount of silver is reduced.

In the examples described above the effects of the present invention are clearly demonstrated.

While the invention has been described in detail and with reference to specific embodiments thereof, it will be apparent to one skilled in the art that various changes and modifications can be made therein without departing from the spirit and scope thereof.

What is claimed is:

1. A method for forming an image, which comprises heating to at least 50° C. a light-sensitive material comprising a support having thereon at least a light-sensitive silver halide, a binder, and a dye providing substance simultaneously with or after imagewise exposure thereof in the presence of water, a reducing agent, and at least one intensifying agent, wherein the intensifying agent is a peroxide, a cobalt (III) complex, a salt of halogenous acid or a polyvalent iodine compound and wherein the amount of water is in a range from 0.1 time the total weight of the whole coated layer(s) to the weight of water corresponding to the maximum swelling volume of the whole coated layer(s).

2. A method for forming an image as in claim 1, wherein the amount of water is in a range of from 0.1 time the total weight of the whole coated layer(s) to a value obtained by subtracting the total weight of the whole coated layer(s) from the weight of water corresponding to the maximum swelling volume of the whole coated layer(s).

3. A method for forming an image as in claim 1, wherein the heating is carried out at a temperature in the range of from 50° C. to 100° C.

4. A method for forming an image as in claim 1, wherein the water is supplied externally.

5. A method for forming an image as in claim 1, wherein the binder is a hydrophilic binder.

6. A method for forming an image as in claim 1, wherein the intensifying agent is a compound having a molar extinction coefficient of 100 or less at 400 nm.

7. A method for forming an image as in claim 1, wherein the intensifying agent is incorporated into a dye fixing material.

8. A method for forming an image as in claim 1, wherein the intensifying agent is supplied externally.

9. A method for forming an image as in claim 8, wherein the intensifying agent is supplied as an aqueous solution thereof.

10. A method for forming an image as in claim 1, wherein the heating is carried out at a pH in the layer of from 7 to 12.

11. A method for forming an image a in claim 1, wherein the reducing agent is incorporated into the light-sensitive material.

12. A method for forming an image as in claim 1, wherein the reducing agent is an inorganic or organic reducing agent or a precursor thereof.

13. A method for forming an image as in claim 1, wherein the material further contains an organic silver salt oxidizing agent.

14. A method for forming an image as in claim 1, wherein the dye providing substance is a compound which forms a mobile dye or releases a mobile dye in correspondence or countercorrespondence to the reaction wherein the light-sensitive silver halide is reduced to silver by the heating.

15. A method for forming an image as in claim 1, wherein the dye providing substance and the reducing agent are a compound which acts as a reducing agent and releases a mobile dye.

16. A method for forming an image in claim 14, wherein the dye providing substance is a coupler capable of forming a color image upon a coupling reaction with an oxidation product of a developing agent.

17. A method for forming an image as in claim 1, wherein the dye providing substance is a coupler capable of releasing a diffusible dye upon a coupling reaction with an oxidation product of a developing agent.

18. A method for forming an image as in claim 1, wherein the material further contains an image formation accelerator.

19. A method for forming an image as in claim 18, wherein the image formation accelerator is a base, a base precursor, a nucleophilic compound, an oil, a thermal solvent, a surface active agent or a compound having an interaction with silver or a silver ion.

20. A method for forming an image as in claim 1, wherein the light-sensitive material comprises a support having thereon at least three silver halide emulsion layers sensitive to different spectral wavelength regions.

21. A method for forming an image as in claim 20, wherein each of the three silver halide emulsion layers is sensitive to blue light, green light, red light, or infrared light.

22. A method for forming an image as in claim 20, wherein each of the three silver halide emulsion layers contains a yellow, magenta, or cyan dye-providing substance.

* * * * *